US011324318B2

(12) United States Patent
Miller

(10) Patent No.: US 11,324,318 B2
(45) Date of Patent: May 10, 2022

(54) APRON FRONT SINK PANEL ASSEMBLY

(71) Applicant: Kohler Co., Kohler, WI (US)

(72) Inventor: Jason R. Miller, Elkhart Lake, WI (US)

(73) Assignee: KOHLER CO., Kohler, WI (US)

( * ) Notice: Subject to any disclaimer, the term of this patent is extended or adjusted under 35 U.S.C. 154(b) by 30 days.

(21) Appl. No.: 16/589,967

(22) Filed: Oct. 1, 2019

(65) Prior Publication Data

US 2020/0107637 A1 Apr. 9, 2020

Related U.S. Application Data

(60) Provisional application No. 62/740,995, filed on Oct. 4, 2018.

(51) Int. Cl.
*A47B 96/20* (2006.01)
*E03C 1/18* (2006.01)

(52) U.S. Cl.
CPC ..... *A47B 96/205* (2013.01); *A47B 96/20* (2013.01); *A47B 96/201* (2013.01); *E03C 1/18* (2013.01); *A47B 2096/207* (2013.01)

(58) Field of Classification Search
CPC .. A47B 96/20; A47B 96/205; A47B 2096/207
See application file for complete search history.

(56) References Cited

U.S. PATENT DOCUMENTS 208,094 A 9/1878 Higgins
526,390 A 9/1894 Glauber
594,962 A 12/1897 McManus
792,498 A 6/1905 Carr
832,309 A 10/1906 Frey
(Continued)

FOREIGN PATENT DOCUMENTS

CN 1229626 A 9/1999
CN 1757837 A 4/2006
(Continued)

OTHER PUBLICATIONS

"Blanco One™ Super Single Bowl," retrieved from https://www.blanco.com/en_us/en_us/sinks/product_catalog/sink.html?sid=BLANCO ONE Super Single Bowl&filter=true, 3 pages (no date).
(Continued)

*Primary Examiner* — Daniel J Rohrhoff
(74) *Attorney, Agent, or Firm* — Foley & Lardner LLP

(57) ABSTRACT

A panel assembly for providing an apron-front aesthetic for a sink installed in a cabinet. The panel assembly includes a mounting body configured for coupling to a cabinet and a cover panel coupled to the mounting body to provide an apron-front aesthetic for a sink coupled to the cabinet. The mounting body may include an opening and the cover panel may be located within the opening. The mounting body may be configured to couple to a portion of the cabinet where a false drawer would normally be located. The panel assembly may include a fastener configured to extend through a portion of the mounting body to engage the cover panel so as to secure the cover panel in place with respect to the mounting body. The cover panel may be generally planar and have a metallic finish or a textured surface finish.

22 Claims, 10 Drawing Sheets

(56) References Cited

U.S. PATENT DOCUMENTS 915,057 A 3/1909 Monahan
948,954 A 2/1910 Cody
958,857 A 5/1910 Dennis
981,448 A 1/1911 Matthews
1,006,994 A 10/1911 Barnes
1,225,308 A 5/1917 Born
1,408,812 A 3/1922 Leighton
1,576,607 A 3/1926 Hasskarl
1,579,374 A 4/1926 Leighton
1,587,693 A 6/1926 Beland
1,618,032 A 2/1927 Frederic
1,880,733 A 10/1932 Bolhuis
1,986,935 A 1/1935 Levine
2,005,459 A 6/1935 Finn
2,045,965 A 6/1936 Rosen
2,065,347 A 12/1936 Schulse
2,098,374 A 11/1937 Bullock
2,131,111 A 9/1938 Marsh
2,141,347 A 12/1938 Davis
2,194,343 A 3/1940 Wexler
2,308,123 A 1/1943 Charles
2,309,851 A 2/1943 Kuhne
2,341,093 A 2/1944 Haberstump
2,367,161 A 1/1945 Wild
2,441,752 A 5/1948 Campbell
2,457,918 A 1/1949 Pierce
2,473,862 A 6/1949 Clawsey
2,508,808 A 5/1950 Warman
2,510,238 A 6/1950 Mau
2,534,793 A 12/1950 Olson
2,597,925 A 5/1952 Edger
2,668,300 A 2/1954 Grill
2,691,237 A 10/1954 Heim
2,818,579 A 1/1958 Louis
2,825,177 A 3/1958 Nordlof
2,853,750 A 9/1958 Davies et al.
D184,799 S 4/1959 Clemens
D188,090 S 6/1960 Rasmussen
2,977,082 A 3/1961 Harris
2,988,755 A 6/1961 Roland
3,023,991 A 3/1962 Fisher
3,051,160 A 8/1962 Nielsen
3,070,812 A 1/1963 Skrmetta
3,142,295 A 7/1964 Blee
3,169,743 A 2/1965 Page, Jr.
3,204,601 A 9/1965 Staver
3,289,218 A 12/1966 Mehilos
3,289,990 A 12/1966 Grantham
3,472,391 A 10/1969 Bolognesi
3,502,384 A 3/1970 Gipson
D217,164 S 4/1970 Jarema
3,508,282 A 4/1970 Phillips, Jr.
D218,330 S 8/1970 Hagopian
3,552,705 A 1/1971 Caster
D222,087 S 9/1971 Hagopian
3,625,162 A 12/1971 Crew
D223,501 S 4/1972 Hamburg
3,680,152 A 8/1972 Farrell
3,742,965 A 7/1973 Hudziak
3,813,706 A 6/1974 Williams
3,827,020 A 7/1974 Okamoto
4,033,461 A 7/1977 Nevai
4,041,964 A 8/1977 Shamoon
4,082,391 A 4/1978 Turner
D249,207 S 9/1978 Emmer
4,114,967 A 9/1978 Weekly
D253,147 S 10/1979 Heckler
D253,148 S 10/1979 Heckler
D253,149 S 10/1979 Heckler
4,207,975 A 6/1980 Arzillo
4,305,166 A 12/1981 Rose
4,351,073 A 9/1982 Elsas
4,357,957 A 11/1982 Bisonaya et al.
4,370,762 A 2/1983 Heil
4,387,738 A 6/1983 Bisonaya et al.
4,456,021 A 6/1984 Leavens
4,458,705 A 7/1984 Cawood
D277,820 S 3/1985 Maayeh
4,531,246 A 7/1985 Earley
4,698,861 A 10/1987 Bogusz
4,720,879 A 1/1988 Rabban
4,884,714 A 12/1989 Bechtel
5,012,537 A 5/1991 Underwood
5,181,285 A 1/1993 Kolada
5,199,119 A 4/1993 Weber
5,217,123 A 6/1993 Riley et al.
5,232,189 A 8/1993 Koch
5,239,711 A 8/1993 Tafur
5,253,752 A 10/1993 Jang
D341,049 S 11/1993 Hugh
5,275,363 A 1/1994 Dennis
5,279,007 A 1/1994 Kolada
5,367,278 A 11/1994 Yoshikawa
5,368,268 A 11/1994 Jodwischat
D353,652 S 12/1994 Dannenberg
5,377,941 A 1/1995 Har et al.
D358,457 S 5/1995 Dannenberg
5,417,397 A 5/1995 Harnett
D365,235 S 12/1995 Jodwischat
5,485,859 A 1/1996 Johnson et al.
5,485,927 A 1/1996 Hubbard
D375,219 S 11/1996 Selent
5,590,804 A 1/1997 Crum et al.
5,642,871 A 7/1997 Repert et al.
5,715,547 A 2/1998 Becker et al.
5,864,898 A * 2/1999 Knapp ..... A47K 3/161 4/584
5,865,325 A 2/1999 Comstock
5,940,906 A * 8/1999 Halloran ..... A47K 3/161 4/584
5,947,439 A 9/1999 Florey
D421,490 S 3/2000 Talerico
6,062,397 A 5/2000 Licari
6,092,772 A 7/2000 Garcia et al.
6,154,895 A * 12/2000 Pisklak ..... E03C 1/18 4/584
6,212,707 B1 4/2001 Thompson et al.
6,216,992 B1 4/2001 Bisonaya et al.
6,223,362 B1 5/2001 Liang
D444,216 S 6/2001 Katz et al.
D444,548 S 7/2001 Katz et al.
D444,549 S 7/2001 Katz et al.
6,276,675 B1 8/2001 Shamoon
D451,585 S 12/2001 Svendsen et al.
6,330,948 B1 12/2001 Leto
6,338,171 B1 1/2002 Dandridge
6,341,704 B1 1/2002 Michel, Jr.
6,341,770 B1 1/2002 Landherr
D458,493 S 6/2002 Cascio
D458,494 S 6/2002 Cascio
6,446,280 B1 9/2002 Moore, Jr.
D473,294 S 4/2003 Genslak et al.
6,543,071 B1 * 4/2003 Lenner ..... A47C 19/022 312/204
6,557,956 B2 5/2003 Hightower
6,564,398 B1 5/2003 Trott
D477,949 S 8/2003 Cascio et al.
D477,950 S 8/2003 Cascio et al.
D478,444 S 8/2003 Cascio et al.
6,619,604 B1 9/2003 Stillman
6,658,677 B2 * 12/2003 Paul ..... A47C 19/022 16/417
D484,956 S 1/2004 Rachiele
D492,983 S 7/2004 Rachiele
D494,257 S 8/2004 Moran et al.
D494,665 S 8/2004 Herbeau
6,793,190 B2 9/2004 White
6,793,193 B2 9/2004 De Groote
6,808,147 B2 10/2004 Brannen et al.
D498,291 S 11/2004 Bayer
D499,468 S 12/2004 Trepanier
D499,799 S 12/2004 Trepanier
D499,800 S 12/2004 Trepanier
D501,041 S 1/2005 Moran et al.

(56) References Cited

U.S. PATENT DOCUMENTS

D501,541 S 2/2005 Gordon
6,857,616 B1 2/2005 Gasperi et al.
6,910,604 B2 6/2005 Gugliotti et al.
D507,041 S 7/2005 Douglass et al.
D508,984 S 8/2005 Gordon
6,929,232 B1 8/2005 Gasperi et al.
6,991,200 B2 1/2006 Stillman
D518,560 S 4/2006 Arkay-Leliever
D520,611 S 5/2006 Wozniczka et al.
D520,612 S 5/2006 Wozniczka et al.
7,039,963 B2 5/2006 Loberger et al.
D525,689 S 7/2006 Wozniczka et al.
7,086,099 B2 8/2006 Rocci
D527,808 S 9/2006 Wozniczka et al.
D529,148 S 9/2006 Douglass
D529,999 S 10/2006 Lonneman et al.
D530,001 S 10/2006 Lonneman et al.
D530,403 S 10/2006 Lonneman et al.
D530,404 S 10/2006 Lonneman et al.
D530,405 S 10/2006 Douglass et al.
D530,797 S 10/2006 Lonneman
D537,149 S 2/2007 Douglass et al.
7,178,886 B2 2/2007 Hightower
D537,997 S 3/2007 Plikuhn
D538,497 S 3/2007 Plikuhn
D539,396 S 3/2007 Plikuhn et al.
D544,074 S 6/2007 Douglass et al.
D545,408 S 6/2007 Plikuhn
D545,409 S 6/2007 Plikuhn
D546,426 S 7/2007 Plikuhn
D546,929 S 7/2007 Schneider et al.
D547,838 S 7/2007 Plikuhn
7,246,387 B2 7/2007 Erickson et al.
D548,311 S 8/2007 Mahon
D551,742 S 9/2007 Plikuhn
D552,222 S 10/2007 Tortorello
7,278,175 B2 * 10/2007 Torres ..... A47K 3/161 4/584
D556,297 S 11/2007 Baade et al.
D556,848 S 12/2007 Ruggiero et al.
D556,868 S 12/2007 Tortorello
D558,311 S 12/2007 Adams
7,305,723 B2 12/2007 Fulks
D559,366 S 1/2008 Chong
7,377,661 B2 5/2008 Douglass
D573,701 S 7/2008 Rachiele
7,424,949 B2 9/2008 Kumar
D585,126 S 1/2009 Eilmus et al.
7,481,473 B1 1/2009 Warning
D587,789 S 3/2009 Drake
D587,790 S 3/2009 Tortorello et al.
D588,677 S 3/2009 Drake
D588,678 S 3/2009 Chong et al.
D588,679 S 3/2009 Cheng
D588,680 S 3/2009 Cheng
D588,685 S 3/2009 Chong
D589,222 S 3/2009 Gicela et al.
7,503,534 B2 3/2009 Pollack
7,568,239 B2 8/2009 Spruner Von Mertz et al.
7,578,399 B1 8/2009 Mulaw
D600,334 S 9/2009 Chong
7,594,706 B2 9/2009 Styka et al.
D603,026 S 10/2009 DeBoer et al.
D603,027 S 10/2009 DeBoer et al.
D603,029 S 10/2009 Bucher
D603,334 S 11/2009 Suzuki
D603,486 S 11/2009 Mayer et al.
7,699,277 B2 4/2010 Bagnall
7,721,362 B2 5/2010 Martin et al.
7,726,521 B2 6/2010 Bassett et al.
7,731,846 B1 6/2010 Jones
7,735,661 B1 6/2010 Sumner et al.
D624,635 S 9/2010 Eckhaus
D627,449 S 11/2010 Eckhaus
7,841,473 B2 11/2010 Huang et al.
7,854,030 B2 12/2010 Lee et al.
D636,138 S 4/2011 Talerico
8,070,148 B2 12/2011 Nishida
D651,699 S 1/2012 Booth et al.
8,088,468 B2 1/2012 Maggio
8,096,678 B2 1/2012 Jones et al.
D655,798 S 3/2012 Miller et al.
D657,028 S 4/2012 Eilmus
8,185,980 B2 5/2012 Adams et al.
D662,574 S 6/2012 Booth et al.
D663,389 S 7/2012 Miller et al.
D663,395 S 7/2012 Miller et al.
8,214,939 B2 7/2012 Spurlock
8,296,876 B2 10/2012 Yang et al.
D670,364 S 11/2012 Miller et al.
D670,366 S 11/2012 Booth et al.
D670,367 S 11/2012 Miller et al.
D671,197 S 11/2012 Miller et al.
D675,300 S 1/2013 Miller et al.
8,393,022 B2 3/2013 Dachowski
D682,998 S 5/2013 Eilmus
D685,456 S 7/2013 Eckhaus
D685,457 S 7/2013 Eckhaus
8,484,916 B2 7/2013 Farag
8,511,762 B2 8/2013 Stegerwald
D698,905 S 2/2014 Ziemann et al.
D699,012 S 2/2014 Ziemann et al.
D699,013 S 2/2014 Ziemann et al.
D699,330 S 2/2014 Ziemann et al.
D700,301 S 2/2014 Rachiele
8,684,192 B1 4/2014 Margolin
8,801,926 B2 8/2014 Housley
8,844,070 B2 * 9/2014 Booth ..... E03C 1/33 4/631
8,870,306 B2 10/2014 Simon
8,925,124 B2 1/2015 Littlehorn, Sr.
D722,145 S 2/2015 Morales et al.
D725,757 S 3/2015 Morales et al.
9,032,567 B1 5/2015 Galgano
9,066,631 B2 6/2015 Didehvar et al.
9,073,096 B2 7/2015 Ehman
9,085,884 B2 7/2015 Lopchinsky
9,115,484 B2 8/2015 Fulford et al.
9,173,487 B2 * 11/2015 Booth ..... E03C 1/18
9,226,621 B1 1/2016 Jones et al.
9,228,331 B1 1/2016 Weinstein
9,238,907 B2 1/2016 Murray
9,260,845 B1 2/2016 Siegel
9,291,301 B2 3/2016 Brinkmann
9,380,917 B2 7/2016 Eilmus et al.
9,414,717 B2 8/2016 Tollasepp et al.
9,416,538 B2 * 8/2016 Torres ..... A47K 3/161
9,427,135 B2 8/2016 Audet et al.
9,567,735 B2 2/2017 Siegel
9,574,333 B2 2/2017 O'Brien et al.
9,622,621 B2 4/2017 Brinkmann
9,708,064 B2 7/2017 Vandewall et al.
9,750,375 B2 9/2017 Byun
D799,648 S 10/2017 Chong
D799,649 S 10/2017 Chong
9,775,470 B2 10/2017 Eilmus et al.
9,783,967 B2 10/2017 Jain et al.
9,790,671 B2 10/2017 Jones et al.
9,808,123 B1 11/2017 Brinkmann
D804,620 S 12/2017 Palazzolo et al.
D816,197 S 4/2018 Chong et al.
9,930,998 B2 4/2018 Palazzolo et al.
D821,670 S 6/2018 Lynch
D824,628 S 7/2018 Lynch
10,092,097 B2 10/2018 Booth et al.
10,151,085 B2 * 12/2018 Chong ..... E03C 1/182
D845,451 S 4/2019 Swilley
D861,837 S 10/2019 Chong et al.
D865,138 S 10/2019 Lyons
10,501,919 B2 12/2019 Chong et al.
D872,243 S 1/2020 Wegner et al.
D886,255 S 6/2020 Wegner et al.
D911,497 S 2/2021 Levi
2004/0016052 A1 1/2004 Domenig

(56) References Cited

U.S. PATENT DOCUMENTS

| | | | | |
|---|---|---|---|---|
| 2005/0044625 | A1 | 3/2005 | Kommers | |
| 2005/0155147 | A1 | 7/2005 | Trepanier et al. | |
| 2005/0223486 | A1 | 10/2005 | Jumalon | |
| 2007/0157378 | A1 | 7/2007 | Kendall et al. | |
| 2009/0094741 | A1 | 4/2009 | Valadez et al. | |
| 2009/0139023 | A1 | 6/2009 | Talerico | |
| 2009/0172876 | A1 | 7/2009 | Hendrickson et al. | |
| 2009/0314730 | A1 | 12/2009 | Mansikkamaa | |
| 2010/0072147 | A1 | 3/2010 | Reenberg et al. | |
| 2010/0116955 | A1 | 5/2010 | Hayes et al. | |
| 2010/0148896 | A1 | 6/2010 | Hugo | |
| 2010/0213145 | A1 | 8/2010 | Swank | |
| 2010/0254125 | A1 | 10/2010 | Jones et al. | |
| 2010/0275367 | A1 | 11/2010 | Bager et al. | |
| 2010/0275368 | A1 | 11/2010 | Miller et al. | |
| 2010/0275369 | A1 | 11/2010 | Eilmus et al. | |
| 2011/0056016 | A1 | 3/2011 | Mun | |
| 2011/0101199 | A1 | 5/2011 | Andrade | |
| 2011/0163510 | A1 | 7/2011 | Wedi | |
| 2011/0219535 | A1 | 9/2011 | Bouroullec et al. | |
| 2011/0303626 | A1 | 12/2011 | Roenne | |
| 2012/0169192 | A1* | 7/2012 | Simon | A47B 96/20 312/228 |
| 2012/0222211 | A1 | 9/2012 | Booth et al. | |
| 2012/0240330 | A1 | 9/2012 | Fulford et al. | |
| 2013/0337220 | A1* | 12/2013 | Janke | A47B 88/956 428/99 |
| 2014/0041113 | A1 | 2/2014 | Mobbs | |
| 2014/0245533 | A1 | 9/2014 | Lee et al. | |
| 2014/0259381 | A1 | 9/2014 | Fogerlie | |
| 2014/0346102 | A1 | 11/2014 | Housley | |
| 2014/0366263 | A1 | 12/2014 | Thompson et al. | |
| 2015/0122961 | A1 | 5/2015 | Batiste et al. | |
| 2015/0128339 | A1 | 5/2015 | Warner | |
| 2015/0230667 | A1 | 8/2015 | Palazzolo et al. | |
| 2015/0284937 | A1 | 10/2015 | Baier et al. | |
| 2016/0045027 | A1 | 2/2016 | Alkoby | |
| 2016/0215484 | A1 | 7/2016 | Williams | |
| 2016/0235201 | A1* | 8/2016 | Soot | F21V 33/0012 |
| 2016/0256804 | A1 | 9/2016 | Medeiros | |
| 2017/0027387 | A1 | 2/2017 | Lakshmi Narasimhan | |
| 2017/0130433 | A1* | 5/2017 | Franco | E03C 1/181 |
| 2017/0172379 | A1 | 6/2017 | Keller et al. | |
| 2017/0245693 | A1 | 8/2017 | Palazzolo et al. | |
| 2017/0295960 | A1* | 10/2017 | Allen | B44C 5/04 |
| 2018/0030702 | A1 | 2/2018 | Childs et al. | |
| 2018/0030703 | A1 | 2/2018 | Cagliari et al. | |
| 2018/0030704 | A1 | 2/2018 | Bomatter et al. | |
| 2018/0030705 | A1 | 2/2018 | Bomatter et al. | |
| 2018/0125305 | A1 | 5/2018 | Richards | |
| 2018/0187400 | A1 | 7/2018 | Chong et al. | |
| 2018/0187401 | A1 | 7/2018 | Chong et al. | |
| 2018/0187403 | A1* | 7/2018 | Chong | E03C 1/182 |
| 2020/0063412 | A1* | 2/2020 | Miller | A47B 96/20 |
| 2020/0352331 | A1* | 11/2020 | Graf | A47C 19/02 |

FOREIGN PATENT DOCUMENTS

| | | | |
|---|---|---|---|
| CN | 1938495 | A | 3/2007 |
| CN | 102105642 | A | 6/2011 |
| CN | 102791919 | A | 11/2012 |
| CN | 104912281 | A | 9/2015 |
| CN | 105496036 | A | 4/2016 |
| CN | 105908812 | A | 8/2016 |
| CN | 207285669 | | 5/2018 |
| DE | 26 58 193 | B1 | 7/1978 |
| DE | 39 28 806 | A1 | 11/1990 |
| EP | 0 968 078 | | 1/2000 |
| EP | 1 442 691 | A1 | 8/2004 |
| EP | 2 168 750 | A1 | 3/2010 |
| FR | 2887416 | B1 | 11/2008 |
| GB | 2 214 127 | A | 8/1989 |
| JP | S5555842 | A | 4/1980 |
| JP | 937863 | A | 2/1997 |
| JP | H0937863 | A | 2/1997 |
| JP | H119487 | A | 1/1999 |
| JP | H119488 | A | 1/1999 |
| JP | H11-346951 | A | 12/1999 |
| JP | 5088124 | B2 | 12/2012 |
| WO | WO-2012/069682 | A1 | 5/2012 |
| WO | WO-2012/134118 | A2 | 10/2012 |
| WO | WO-2016/062519 | A1 | 4/2016 |

OTHER PUBLICATIONS

"ELXUFP3620: Elkay Quartz Luxe 35-7/8" x 20-15/16" x 9" Single Bowl Farmhouse Sink with Perfect Drain," retrieved from https://www.elkay.com/products/elxufp3620.html, 2 pages (no date).

Belle Foret. "Apron Front Kitchen Sink". Model No. BFF1KIT. BelleForet.com online catalog. All Contents Copyright, Your 'Other Warehouse. (1 page).

Bellucci 30" Flat Apron Front Granite Quartz Composite Single Bowl Kitchen Sink in Brown, https://www.kraususa.com/kraus-kgf1-30brown-30-flat-apron-front-granite-quartz-composite-single-bowl-kitchen-sink-in-brown.html, accessed Sep. 14, 2020, pp. 1-4.

Bellucci 30" Flat Apron Front Granite Quartz Composite Single Bowl Kitchen Sink in White, https://www.kraususa.com/kraus-kgf1-30white-30-flat-apron-front-granite-quartz-composite-single-bowl-kitchen-sink-in-white.html, accessed Sep. 14, 2020, pp. 1-4.

Bellucci 30" Flat Apron Granite Quartz Composite Single Bowl Kitchen Sink in Black, https://www.kraususa.com/kraus-kgf1-30black-30-flat-apron-front-granite-quartz-composite-single-bowl-kitchen-sink-in-black.html, accessed Sep. 14, 2020, pp. 1-4.

Bellucci 33" Flat Apron Front Granite Quartz Composite Single Bowl Kitchen Sink in Black, https://www.kraususa.com/kraus-kgf1-33black-33-flat-apron-front-granite-quartz-composite-single-bowl-kitchen-sink-in-black.html, accessed Sep. 14, 2020, pp. 1-5.

Bellucci 33" Flat Apron Front Granite Quartz Composite Single Bowl Kitchen Sink in Brown, https://www.kraususa.com/kraus-kgf1-33brown-33-flat-apron-front-granite-quartz-composite-single-bowl-kitchen-sink-in-brown.html, accessed Sep. 14, 2020, pp. 1-4.

Bellucci 33" Flat Apron Front Granite Quartz Composite Single Bowl Kitchen Sink in White, Model KGF1-33, https://www.kraususa.com/kraus-kgf1-33white-33-flat-apron-front-granite-quartz-composite-single-bowl-kitchen-sink-in-white.html, accessed Sep. 14, 2020, pp. 1-5.

Bellucci by Kraus—Flat Apron-Front Farmhouse Kitchen Sink Video Snippets, https://www.youtube.com/watch?v=bzwDrUpAPUg, accessed Sep. 14, 2020, pp. 1-7.

Bellucci Workstation 33" Quartz Composite Slngle Bowl Farmhouse Kitchen Sink in Metallic Brown, https://www.kraususa.com/kraus-kgf2-33mbr-workstation-33-quartz-composite-single-bowl-farmhouse-kitchen-sink-in-metallic-brown.html, accessed Sep. 14, 2020, pp. 1-4.

Bellucci Workstation 33" Quartz Composite Single Bowl Farmhouse Kitchen Sink in Metallic Grey, https://www.kraususa.com/kraus-kgf2-33mgr-workstation-33-quartz-composite-single-bowl-farmhouse-kitchen-sink-in-metallic-grey.html, accessed Sep. 14, 2020, pp. 1-4.

Blanco America, "Blanco's New One Stainless Steel Sinks," retrieved from https://youtu.be/ITta7oPFXgA, 2 pages (2014).

Blanco America, "Blanco's New One Stainless Steel Sinks," retrieved from https://youtu.be/ITta7oPFXgA, pp. 1-19 (2014).

Blanco America, "Blanco's New One Stainless Steel Sinks," retrieved from https://youtu.be/ITta7oPFXgA, pp. 1-19 (2014). https://youtu.be/ITta7oPFXgA; accessed Jan. 5, 2021.

Chinese Second Office Action on CN Patent Application No. 201910763481.4 dated Mar. 11, 2021 (7 pages).

Elite Bath Chameleon Stainless, http://elitebath.com/stainless.html, accessed Apr. 19, 2021, pp. 1-2.

FIFTV Kitchen & Bath Fixtures from Kraus USA Video Snippets, https://www.youtube.com/watch?v=48iJF4PKAqA, accessed Sep. 14, 2020, pp. 1-16.

FIFTV Kitchen & Bath Fixtures from Kraus USA Video Snippets, https://www.youtube.com/watch?v=48iJF4PKAqA, accessed Sep. 14, 2020, pp. 1-16 https://www.youtube.com/watch?v=48iJF4PKAqA; accessed Jan. 5, 2021.

(56) References Cited

OTHER PUBLICATIONS

FIFTV Kitchen & Bath Fixtures from Kraus USA Video Snippets, https://www.youtube.com/watch?v=48iJF4PKAqA, accessed Sep. 14, 2020, pp. 1-2.
CN Office Action on CN Appl. Ser. No. 201910763481.4 dated Jul. 30, 2020 (11 pages).
Instawares.com. GSW Stainless Steel Corner Drain Sink Bowl—18.times.24in. Instawares.com online catalog. (1 page).
Kallista. "For Loft by Michael S. Smith Fireclay Kitchen Sink with Drajnboard." Model No. L20300. Kallista.com online catalog. Copyright 2011 Kohler Co. (2 pages).
Kallista. "For Loft by Michael S. Smith Fireclay Kitchen Sink." Model No. L20301. Kallista.com online catalog. Copyright 2011 Kohler Co. (2 pages).
Kallista. "For Town by Michael S. Smith Fireclay Kitchen Sink." Model No. L20303. Kallista.com online catalog. Copyright 2011 Kohler Co. (2 pages).
Kohler Co. "Dickinson Apron-Front, Tile-in Kitchen Sink". Model No. K-6546-3. Kohler Co. online catalog. Copyright 2011 Kohler Co. (3 pages).
Kohler Co. "Dickinson Apron-Front, Tile-in Kitchen Sink". Model No. K-6546-4. Kohler Co. online catalog. Copyright 2011 Kohler Co. (3 pages).
Kohler Co. "Dickinson Apron-Front, Tile-in Kitchen Sink". Model No. K-6546-4U. Kohler Co. online catalog. Copyright 2011 Kohler Co. (3 pages).
Kohler Co. "Hawthorne Apron-Front, Tile-in Kitchen Sink". Model No. K-6534-3. Kohler Co. online catalog. Copyright 2011 Kohler Co.. (3 pages).
Kohler Co. "Hawthorne Apron-Front, Tile-in Kitchen Sink". Model No. K-6534-4. Kohler Co. online catalog. Copyright 2011 Kohler Co. (3 pages).
Kohler Co. "Hawthorne Apron-Front, Tile-in Kitchen Sink". Model No. K-6534-4U. Kohler Co. online catalog. Copyright 2011 Kohler Co. (3 pages).
Kohler Fixtures, Apron Front Sinks, pp. 352-355 (2014).
Kore Workstation 30" Apron Front 16 Guage Stainless Steel Single Bowl Kitchen Sink, https://www.kraususa.com/kraus-kwf410-30-workstation-30-apron-front-16-gauge-stainless-steel-single-bowl-kitchen-sink.html, accessed Sep. 14, 2020, pp. 1-4.
Kraus Bellucci Sink Collection Video Snippets, https://www.youtube.com/watch?v=O_MFn1JLOTg#action=share, accessed Sep. 14, 2020, pp. 1-8.
Kraus Forteza KGF1-33 Farmhouse Apron Kitchen Sink, https://www.wayfair.com/home-improvement/pdp/kraus-forteza-33-l-x-21-w-farmhouseapron-kitchen-sink-kus10133.html?piid=40371630, accessed Sep. 14, 2020, pp. 1-9.
Kraus Installation Guide, "Bellucci Quartz Granite Composite Farmhouse Sink with CeramTek," KGF1-30/KGF1-33, www.kraususa.com, Dec. 3, 2018, pp. 1-15.
Kraus Installation Guide, "Bellucci Quartz Granite Composite Farmhouse Sink," KGF1-30 / KGF1-33, KGF2-30 / KGF2-33, KGF11-30 / KGF11-33, KGF12-30 / KGF12-33, www.kraususa.com, Feb. 19, 2019, pp. 1-15.
Kraus Installation Guide, "Bellucci Quartz Granite Composite Farmhouse Sink," KGF1-30/KGF1-33, KGF2-30/KGF2-33, KGF11-30/KGF11-33, KGF12-30/KGF12-33, www.kraususa.com, Feb. 19, 2019, 1-15.
Kraus Specification Sheet, "KGF1-33 33 Inch Single Bowl Granite Farmhouse Apron Kitchen Sink," www.kraususa.com, Jun. 10, 2019, 1 page.
Linkasink Farm House Kitchen Sink with Inset Apron Front, C071-30 SS, https://static1 .squarespace.com/static/5706844ee707eb7087c2faa7/t/590781fc1e5b6c7f60ac7e2f/1493664254854/c071-30_ss_spec_sheet.pdf, accessed Dec. 15, 2020, pp. 1-3.
Lyons. "Premium 34 .times. 23 Apron Sink". Model No. KSxxAP3.4. Lyons brochure. (3 pages).
Rachiele; "Patented copper apron front sink with channel;" http://www.rachiele.com/copper.sub.—apron.sub.—sinks-with-patent.asp; retrieval date: Nov. 30, 2011; 3 pages.
Rohl. Apron Front Sink. (4 pages).
Screen capture from Dawn USA showing HTML coding with product installation manual date. Retrieved from http://dawnusa.net/productsee4. Screen capture from amazon. com showing earliest available date for sink model DAF3320C dated Oct. 16, 2017 (2 pages).
Shaws Original. Apron Sink. (1 page).
Songbath.com. Apron Front Kitchen Sink. Songbath.com online catalog. (1 page).
Standart PRO 33" Flat Apron Front 16 Guage Stainless Steel Single Bowl Kitchen Sink, Model KHF410-33, https://www.kraususa.com/kraus-khf410-33-33-flat-apron-front-16-gauge-stainless-steel-single-bowl-kitchen-sink.html, accessed Sep. 14, 2020, pp. 1-4.
Texas Lightsmith Luminescent Sinks, https://www.texaslightsmith.com/luminescent-sinks/, accessed Apr. 19, 2021, pp. 1-32.
Wobane Under Cabinet Lighting Kit, https://www.amazon.com/Lighting-Flexible-LED-Cupboard-WarmWhite/dp/B07BF5PB4G/ref=pd_bxgy_img_2/130-1786452-9365555?_encoding=UTF8&pd_rd_i=B07BF5PB4G&pd_rd_r=28e0b463-27d9-4394-bb05-97c57e6bfb1c&pd_rd_w=kLfbC&pd_rd_wg=3R6PF&pf_rd_p=4e3f7fc3-00c8-46a6-a4db-8457e6319578&pf_rd_r=0F23CBD7138W0BTR097T&psc=1&refRID=0F23CBD7138W0BTR097T, pp. 1-12, accessed Jun. 18, 2020.
European Search Report on EP 21153093.6 dated Jun. 9, 2021 (19 pages).
Third Chinese Office Action on CN Patent Application No. 201910763481.4 dated Aug. 10, 2021 (9 pages).

* cited by examiner

APRON FRONT SINK PANEL ASSEMBLY

CROSS-REFERENCE TO RELATED PATENT APPLICATION

The present application claims the benefit of, and priority to, U.S. Provisional Patent Application No. 62/740,995, filed Oct. 4, 2018, the entire disclosure of which is incorporated herein by reference.

BACKGROUND

The present disclosure relates generally to the field of sinks. More specifically, the present disclosure relates to an apron front sink panel that is configured to be installed on a front surface of a cabinet having a sink.

SUMMARY

At least one embodiment of this application is related to a panel assembly for providing an apron-front aesthetic for a sink installed in a cabinet. The panel assembly includes a mounting body configured for coupling to a cabinet. The panel assembly also includes a cover panel coupled to the mounting body to provide an apron-front aesthetic for a sink coupled to the cabinet.

At least one embodiment of this application is related to a sink and cabinet assembly, the assembly including a cabinet. The assembly also includes a sink coupled to the cabinet, the sink comprising a basin. The assembly further includes a countertop coupled to the cabinet. The assembly even further includes a decorative panel assembly coupled to a front portion of the cabinet at a location forward of the basin and below the countertop such that at least a portion of the cabinet is between the sink and the decorative panel assembly. The decorative panel assembly includes a mounting structure coupled to the front of the cabinet and a cover panel coupled to the mounting structure.

At least one embodiment of this application is related to a method of providing an apron-front sink aesthetic to a non-apron-front sink. The method includes the steps of removing a panel from a front portion of a cabinet, the cabinet configured to have a sink coupled thereto; coupling a mounting body to the cabinet at the location where the panel has been removed; and coupling a decorative panel to the mounting body; wherein the decorative panel and mounting body together form a faux apron for a sink coupled to the cabinet.

DETAILED DESCRIPTION

Prior to turning to the FIGURES, which illustrate the one or more exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, a faux apron front sink panel assembly (e.g., panel assembly) having an interchangeable front panel (e.g., cover panel, end cap, etc.) is shown according to various exemplary embodiments. The panel assembly can be installed in various environments, including but not limited to kitchens and bathrooms. A front panel of the panel assembly is configured to couple to a mounting panel on a mounting surface of a portion of a cabinet that is located below a sink. The panel assembly beneficially provides a user with the flexibility to customize the aesthetic of the sink area, such as to match the aesthetic of a kitchen environment (e.g., a kitchen theme), by interchanging the front panel without the need for installing an entire new sink, which can be expensive and time consuming. By way of example, the front panel can be made of a deep-textured stainless steel, which beneficially may provide an appealing aesthetic, while also providing a scratch-resistant surface finish for improved durability and longevity.

Figure 1:
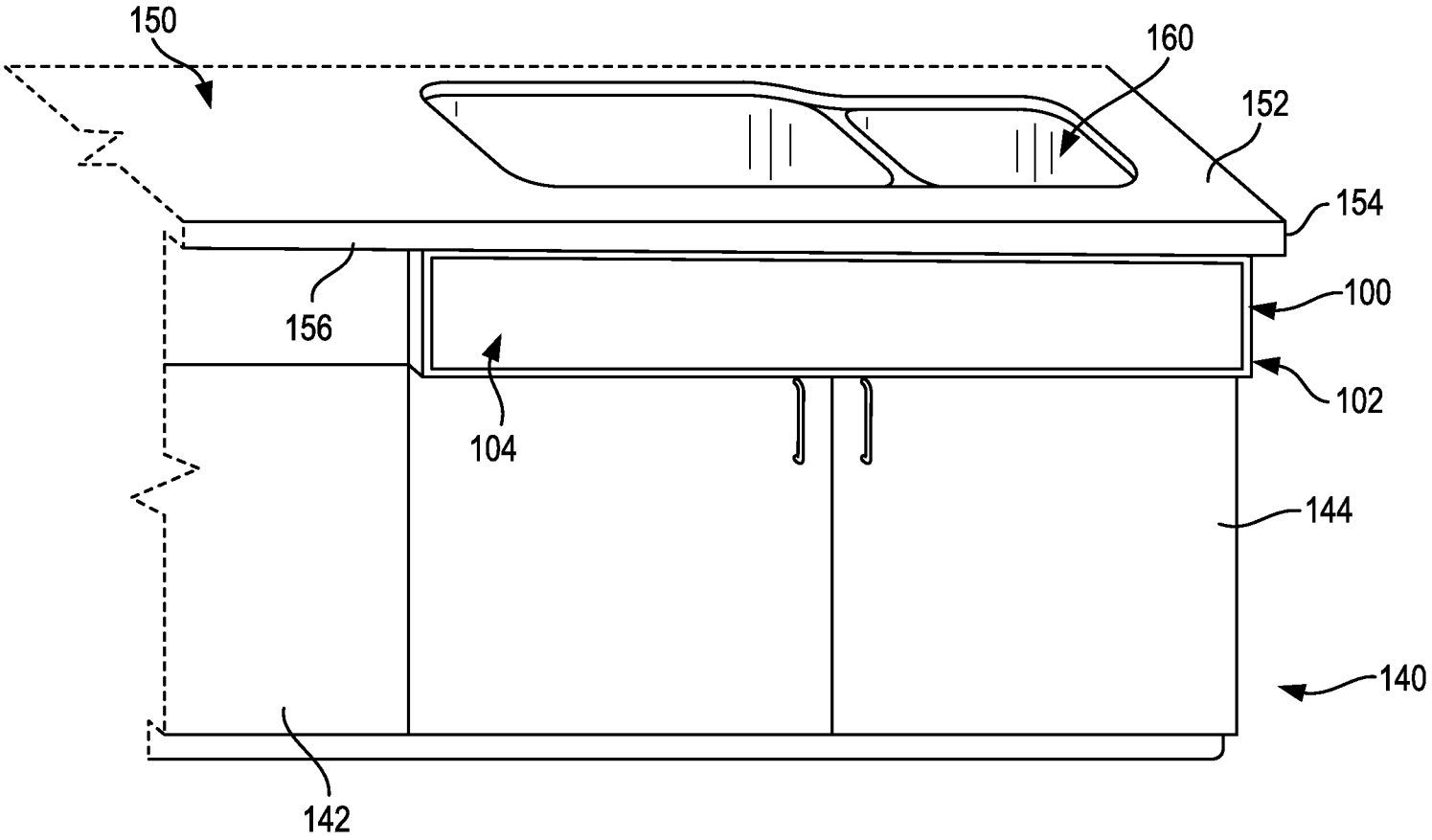
FIG. 1 is a perspective view of a panel assembly coupled to a cabinet assembly, according to an exemplary embodiment.

Referring generally to FIG. 1, a perspective view of a panel assembly (e.g., decorative panel assembly, etc.) 100 is shown according to an exemplary embodiment. The panel assembly 100 is configured to be mounted to a cabinet assembly 140, the cabinet assembly 140 including a front surface 142 and a countertop 150 having a top surface 152. The countertop 150 is coupled to the cabinet assembly 140 and configured to receive or operatively couple to a sink 160 having a basin. FIG. 1 shows the sink 160 as an undermount style, double bowl sink. However, the panel assembly 100 may be operably coupled proximate one or more other types of sinks, including drop-in style sinks, single bowl sinks, single basin sinks, and a variety of similar sinks commonly found in a kitchen or bathroom. The panel assembly 100 is configured to provide an apron-front aesthetic to the sink 160 installed in the cabinet. In some embodiments, the panel assembly 100 is configured to couple to a front portion of the cabinet assembly 140 at a location forward of a sink basin (e.g., the basin of the sink 160) and below the countertop 150 such that at least a portion of the cabinet assembly 140 is between the sink 160 and the panel assembly 100.

The countertop further includes a lip 154 extending laterally away from the sink 160 and disposed above the front surface 142 of the cabinet assembly 140. The lip 154 includes a front lip surface 156. The front lip surface 156 is contiguous with the top surface 152. The front lip surface 156 may be generally parallel to the front surface 142. The front surface 142 of the cabinet assembly 140 is shown to further include two doors 144 proximate the front surface 142. However, it should be appreciated that the cabinet assembly 140 may include any number of doors 144 (e.g., one, two, etc.) or drawers. In some embodiments, the cabinet assembly 140 does not include any doors or drawers. The panel assembly 100 is approximately the same width as the cabinet assembly 140. In some embodiments, the panel assembly 100 is slightly wider than the cabinet assembly 140 such that the panel assembly 100 has an overhang. As shown in FIG. 1, the panel assembly 100 is coupled proximate the front surface 142, above the doors 144 and underneath the lip 154. In some embodiments, the panel assembly 100 is coupled directly to the sink 160.

According to an exemplary embodiment, the panel assembly 100 includes a first mounting body 102 and a generally planar cover panel 104. The illustrated panel assembly 100 may have a substantially vertical orientation and a substantially rectangular cross section when installed. In some embodiments, the panel assembly 100 has curved sides at an angle relative to the front surface 142. The first mounting body 102 is configured for coupling (e.g., to be coupled, to be directly coupled, etc.) to the cabinet assembly 140 for structural support. The cover panel 104 is configured to be coupled to the first mounting body 102 to provide an apron-front aesthetic for the sink 160 coupled to the cabinet assembly 140. The cover panel is further configured to be a forward facing aesthetic panel, such that at least a portion of the cover panel 104 is visible when viewed from the front. The cover panel 104 is detachably coupled to (e.g., coupled within) the first mounting body 102 such that the aesthetics of the panel assembly 100 may be customized by swapping out the cover panel 104 for another cover panel with a different aesthetic (e.g., detaching the cover panel 104 and attaching a similar cover panel). That is, the panel assembly 100 is configured such that the first mounting body 102 can be mounted to the cabinet assembly 140, and a user may selectively change the cover panel 104 to provide a different aesthetic look. In this way, the panel assembly 100 provides a customizable and more cost efficient means of obtaining a different aesthetic look around a sink (e.g., the apron of the sink) without actually replacing the entire sink. Specifically, FIG. 1 illustrates the panel assembly 100 having a first embodiment of the cover panel 104, where the cover panel 104 is configured to be received within an opening of the first mounting body 102 upon installation.

Figure 2:
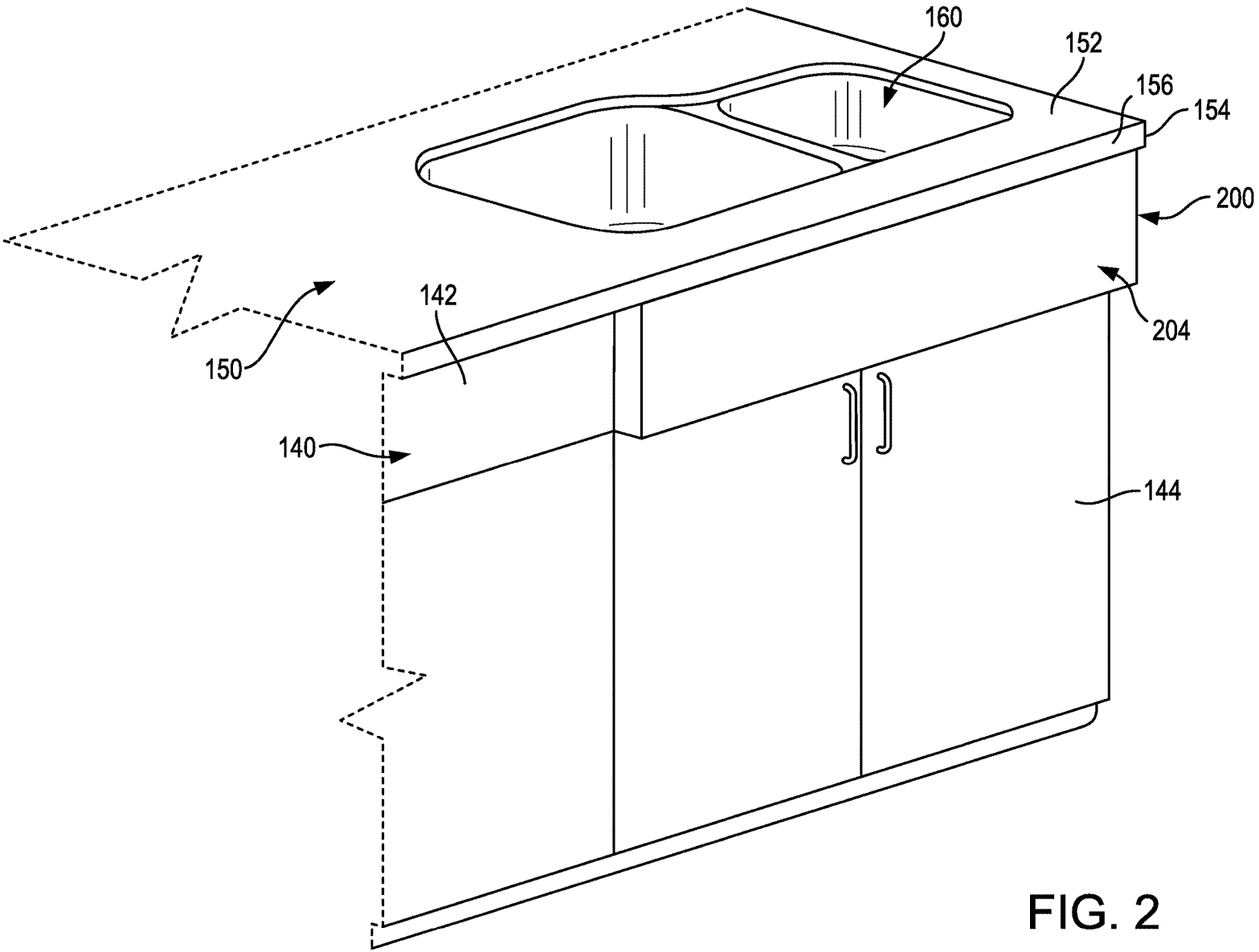
FIG. 2 is a perspective view of a panel assembly coupled to the cabinet assembly, according to another embodiment.

Turning to FIG. 2, a panel assembly (e.g., decorative panel assembly) 200 is shown according to another embodiment. The panel assembly 200 includes a second mounting body (e.g., mounting structure) 202 and an end cap (e.g., decorative panel) 204. The panel assembly 200 is similar to the panel assembly 100. A difference between the panel assembly 100 and the panel assembly 200 is that the end cap 204 is configured to be a forward facing aesthetic end cap, such that at least a portion of the end cap 204 is visible when viewed from the front. The end cap 204 is detachably (e.g., removably) coupled to (e.g., coupled around) the second mounting body 202 such that the aesthetics of the panel assembly 200 may be customized by swapping out the end cap 204 for another end cap with a different aesthetic (e.g., detaching the end cap 204 and attaching a similar end cap). That is, the panel assembly 200 is configured such that the second mounting body 202 can be mounted to the cabinet assembly 140, and a user may selectively change the end cap 204 to provide a different aesthetic look. The end cap 204 of the panel assembly 200 receives the second mounting body 202. As a consequence of the end cap 204 receiving the second mounting body 202, the second mounting body 202 is hidden from view when the panel assembly 200 is viewed from the front. The panel assembly 200 is described in further detail herein (FIGS. 11-16).

Figure 3A:
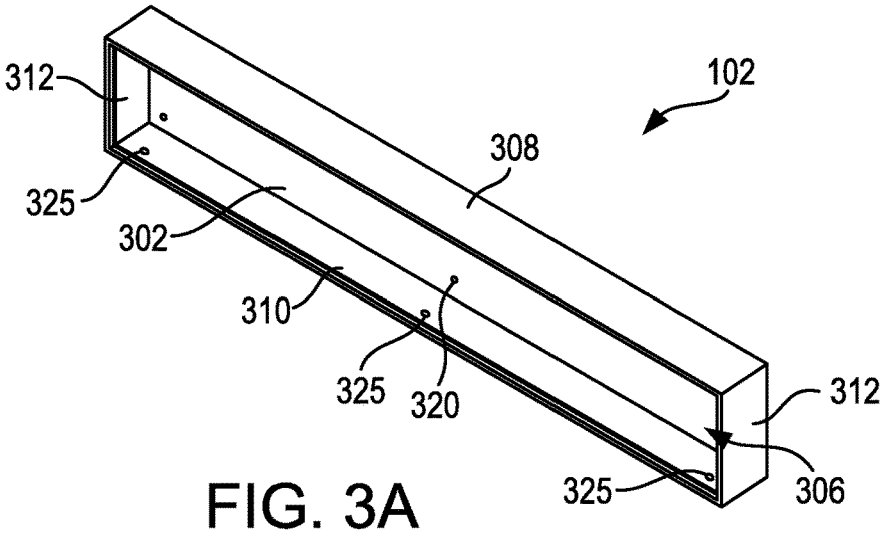
FIG. 3A is a perspective view of a first mounting body of the panel assembly shown in FIG. 1, according to an exemplary embodiment.
Figure 3B:
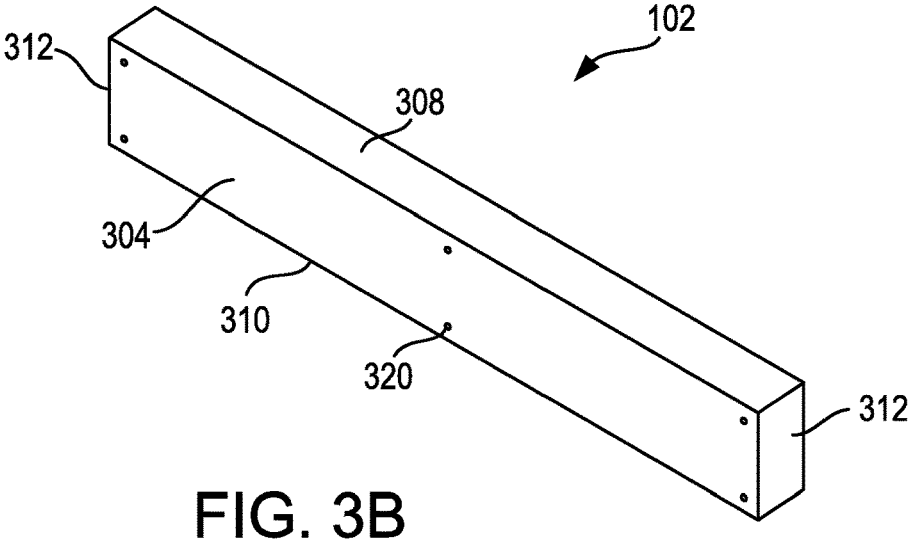
FIG. 3B is a rear view of the first mounting body shown in FIG. 3A.

Referring to FIGS. 3A and 3B, the first mounting body 102 (e.g., mounting panel, mounting frame, receiving body, mounting structure, etc.) is shown in greater detail. The first mounting body 102 includes a base wall having a first front 302 and a first back 304, which are parallel to one another. The first back 304 is planar and is configured to couple proximate to the front surface 142 of the cabinet assembly 140. The first mounting body 102 further includes an opening 306 that is configured to receive the cover panel 104 therein. When fully assembled, the cover panel 104 is located within the opening. The opening 306 is defined by the first front 302, a first top 308 extending laterally away from the first front 302 and generally away from the cabinet assembly 140, a first bottom 310 opposite the first top 308 and extending laterally away from the first front 304 and generally away from the cabinet assembly 140, and two first sides 312. The first top 308 may have a different aesthetic appeal (e.g., finish, color, etc.) than either the first sides 312 or the first front 302. For example, the first top 308 may match a top flange of the sink 160. In some embodiments, the first top 308 may have a first finish, the first front 302 and the first sides 312 may have a second finish different from the first finish, and the top flange of the sink 160 may have a third finish which matches the first finish. In other embodiments, the third finish and the first finish may be different. The first top 308 and the first bottom 310 of the illustrated first mounting body 102 may be parallel to one another and perpendicular to each of the two first sides 312, which are parallel to one another. Thus, the perimeter of the opening 306 may have a substantially rectangular cross section when viewed from the front. In some embodiments, however, the cross-section of the first opening 306 may be any one of a variety of regular or irregular polygons, such as a crescent, trapezoid, ellipse, rhombus, or similar shapes. The first front 302 is shown to include at least one throughgoing counterbore 320 (e.g., the counterbore 320 extends from the first front 302 to the first back 304). Each counterbore 320 is configured to receive a rearward extending fastener, which couples the first mounting body 102 to the cabinet assembly 140. That is, when installed, the first back 304 of the first mounting body 102 will couple proximate to the front surface 142. In some embodiments, the first mounting body 102 may include any number of counterbores 320 that are configured to receive fasteners. Similarly, it should be appreciated that any number or type of fasteners (e.g., bolts, screws, etc.) may be used to couple the first mounting body 102 to the cabinet assembly 140. In addition, in the event that the user instead drills their own holes, it should be appreciated that the first mounting body 102 may not include any counterbores 320 for receiving fasteners. The first bottom 310 is shown to also include at least one bottom aperture 325 configured to receive a fastener to secure the cover panel 104 to the first mounting body 102. For example, the first mounting body 102 of FIG. 3B is shown to include three bottom apertures 325, each of which is configured to receive one fastener. Specifically, the first mounting body 102 is configured to receive at least one fastener extending through the first bottom 310 and into the cover panel 104 to couple the cover panel 104 to the first mounting body 102. In some embodiments, the cover panel 104 may instead be press fit, snapped, latched, slid, nailed, or glued to/into/within the first mounting body 102 such that the bottom apertures 325 may not be needed. The first mounting body 102 can be made of, for example, a metal, such as sheet metal or cast. However, the first mounting body 102 may also be made of, for example, aluminum, wood, stone, glass, or ceramic, as well as any combination thereof and/or any other suitable material, which can be replaced or interchanged to tailor the aesthetics of the panel assembly 100. In some embodiments, the first mounting body 102 may be formed of a material different from the cover panel 104 to achieve a desirable aesthetic appearance.

Figure 4:
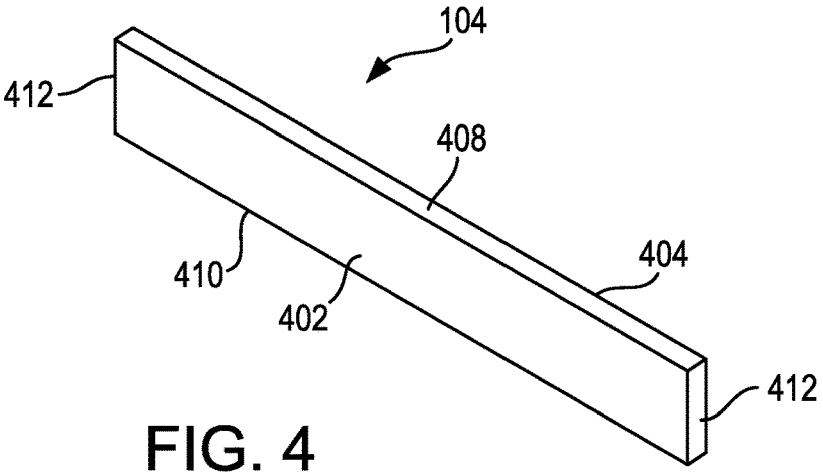
FIG. 4 is a perspective view of a cover panel of the panel assembly shown in FIG. 1, according to an exemplary embodiment.

Referring to FIG. 4, the cover panel 104 is shown according to an exemplary embodiment. The cover panel 104 is shown to include a cover panel front 402, a cover panel back 404 opposite the cover panel front 402, a cover panel top 408, a cover panel bottom 410, and two cover panel sides 412 disposed on opposite ends of the cover panel 104. The cover panel 104 is configured to be located in (e.g., received entirely within, coupled to, etc.) the first opening 306 of the first mounting body 102 upon installation. That is, the cover panel 104 may have a rectangular cross-section that is proportionally slightly smaller than the opening 306 and matches the cross-section of the first mounting body 102 such that there are no gaps between the first walls of the first mounting body 102 and the cover panel walls of the cover panel 104 (e.g., the first top 308 interfaces with the cover panel top 408 such that there is no space between the first top 308 and the cover panel top 408, etc.). In some embodiments, the cross-section of the cover panel 104 is not rectangular, but of another regular or irregular polygon shape. When the panel assembly 100 is installed to the cabinet assembly 140, the cover panel front 402 may be configured to be parallel to the front surface 142. The cover panel front 402 may be further configured to be visible to a user when the cover panel 104 is installed into the opening 306 of the first mounting body 102. The cover panel 104 may be made of, for example, a deep-textured stainless steel, so as to beneficially provide a scratch resistant property. However, the cover panel 104 may also be made of, for example, aluminum, wood, stone, glass, or ceramic, as well as any combination thereof and/or any other suitable material, which can be replaced or interchanged to tailor the aesthetics of the panel assembly 100. The cover panel 104 may be formed of a material different from the first mounting body 102. For example, the first mounting body 102 may be formed of a first material, such as stainless steel, and the cover panel 104 may be formed of a second material different from the first material, such as wood. The cover panel 104, or the cover panel front 402, may further have an aesthetically pleasing finish (e.g., the cover panel 104 includes a decorative pattern). In some embodiments, the cover panel 104 may have the same finish as the sink 160 such that the cover panel 104 and the sink 160 are the same color. In some embodiments, the cover panel 104 has a metallic finish. In some embodiments, the cover panel has a textured surface finish. As will be appreciated by those of ordinary skill, the cover panel 104 may be formed of plastic, but may be given a metallic or reflective finish through plastic chrome plating, vacuum metalizing, or chrome spray paint. When installed, the cover panel back 404 of the cover panel 104 may face and optionally couple to the first front 302 of the first mounting body 102. In some embodiments, the cover panel bottom 410 is configured to interface with an upwardly extending fastener, coupling the cover panel 104 to the first mounting body 102 upon installation. In other embodiments, the cover panel 104 includes latches, pins, adhesive, and/or snaps to help couple the cover panel 104 to the first mounting body 102.

Figure 5:
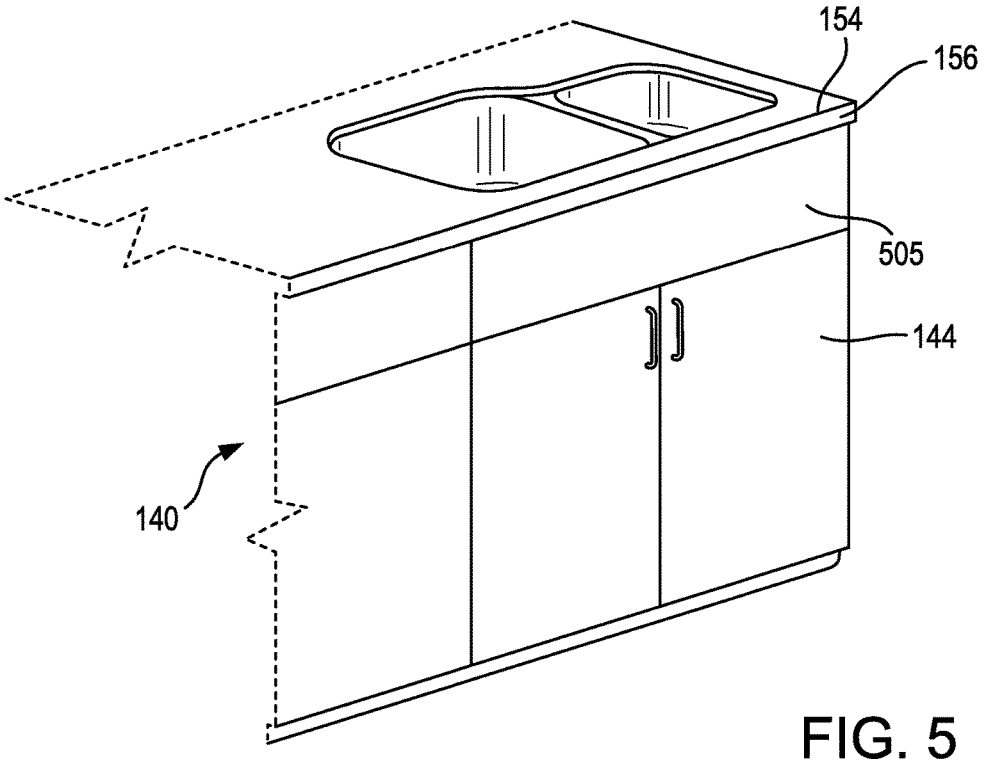
FIGS. 5-10 illustrate the installation process of the panel assembly of FIG. 1.
Figure 6:
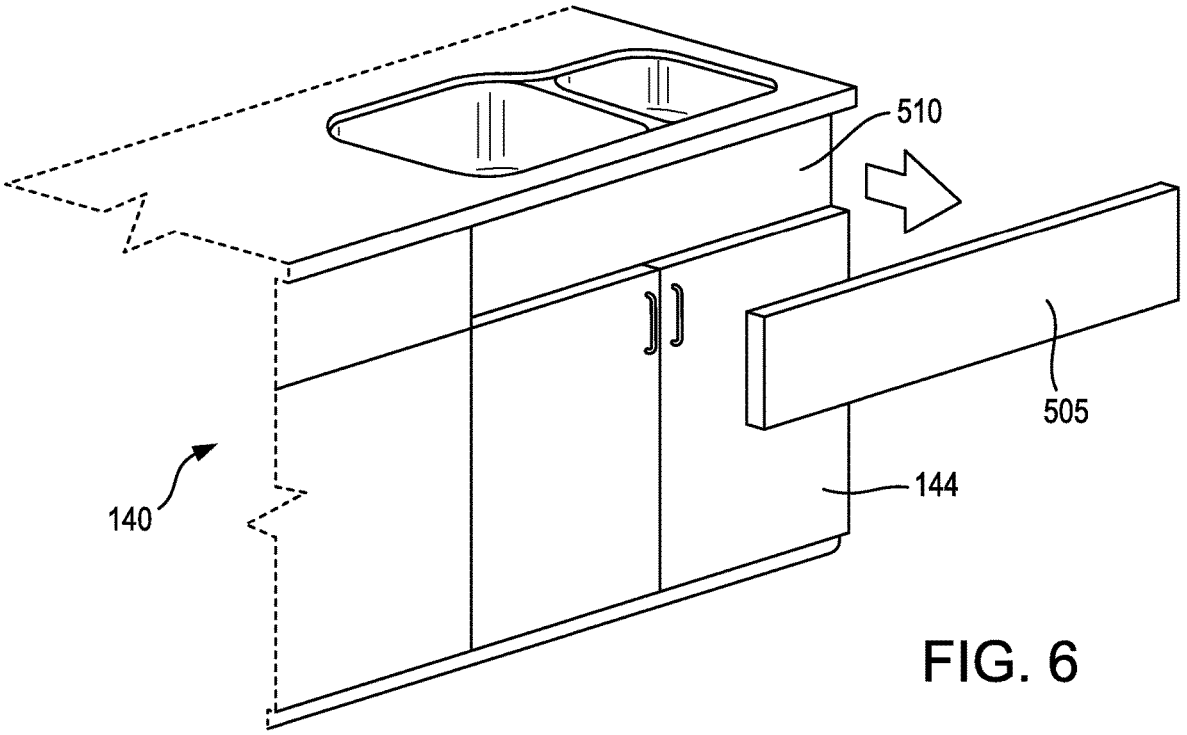

Referring to FIGS. 5-10, the installation process of providing an apron-front sink aesthetic to the cabinet assembly 140. In some embodiments, this is the installation process of providing an apron-front sink aesthetic to a non-apron-front sink installed in the cabinet assembly 140. Referring specifically to FIG. 5, the cabinet assembly 140 is shown prior to the installation of the panel assembly 100. Prior to the installation of the panel assembly 100, the cabinet assembly 140 may include a planar body, shown as a front cabinet panel 505 (e.g., a false drawer front). The front cabinet panel 505 may behave (e.g., appear, etc.) as a false drawer. The front cabinet panel 505 may have a generally rectangular cross-section. The front cabinet panel 505 may have a thickness approximately the same as a thickness of the doors 144. The front cabinet panel 505 may be disposed above the doors 144 and below the lip 154. In some embodiments, a front surface of the front cabinet panel 505 comprises a portion of the front surface 142 of the cabinet assembly 140. Referring now to FIG. 6, removing a panel (e.g., the front cabinet panel 505) from the front of the cabinet assembly 140 is shown. Removing the panel (e.g., the front cabinet panel 505) from the front of the cabinet assembly 140 may be performed after the sink 160 and the countertop 150 are installed (e.g., coupled) to the cabinet assembly 140. The front cabinet panel 505 removed from the cabinet assembly 140 may expose a mounting surface 510. The mounting surface 510 is disposed behind the front cabinet panel 505 and behind the doors 144. The mounting surface 510 may be generally parallel to the front surface 142. In some embodiments, the cabinet assembly 140 does not include the front cabinet panel 505. Accordingly, the illustrated step of removing the front cabinet panel 505 is optional. In the event that the cabinet assembly 140 does not include the front cabinet panel 505, or the user does not wish to remove the front cabinet panel 505 (e.g., to instead install the panel assembly 100 over it), the panel assembly 100 may be coupled to an area defined as below the lip 154 and above the doors 144. In some embodiments, the panel assembly 100 may be sized (e.g., customized, manufactured, etc.) to mount to a variety of cabinet assemblies.

Figure 7:
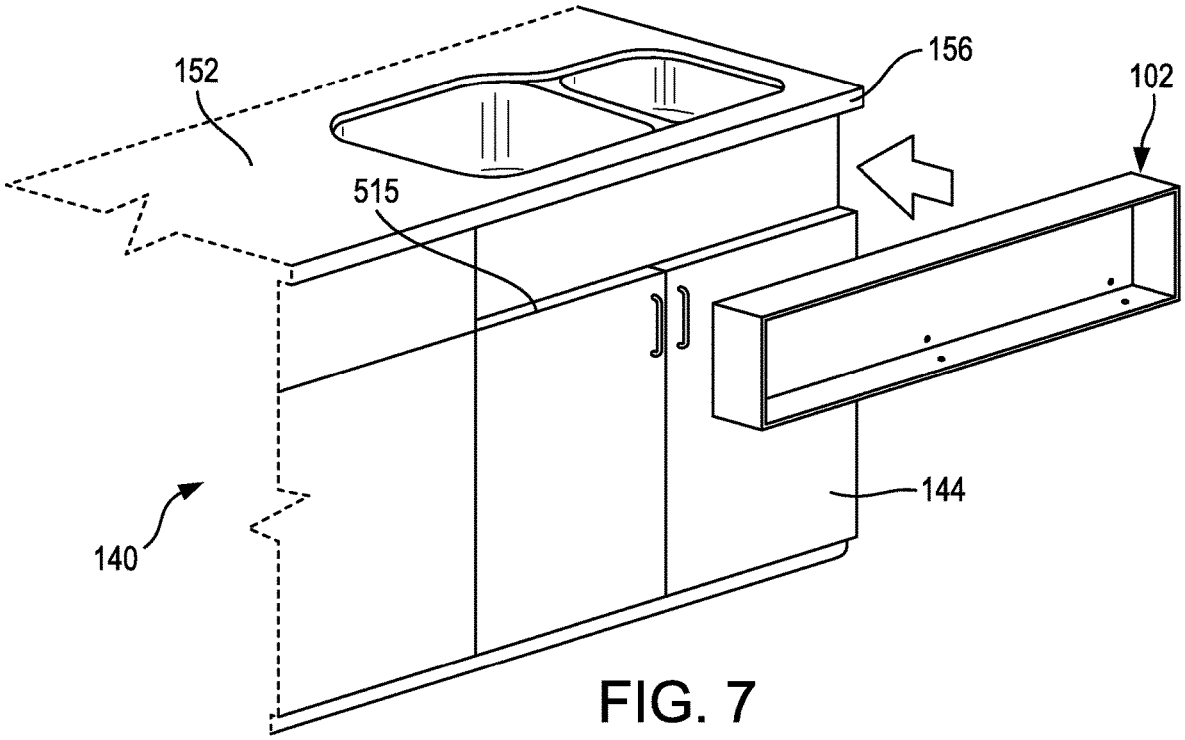

Referring now to FIG. 7, positioning the first mounting body 102 at the location where the panel (e.g., the front cabinet panel 505, the false drawer, etc.) was removed is shown. The first mounting body 102 is configured to couple to a portion of the cabinet assembly 140 where a false drawer would normally be located. In some embodiments, the first mounting body 102 is positioned at a front of the cabinet assembly 140. In some embodiments, the first mounting body 102 is positioned on the mounting surface 510. The first mounting body 102 may be positioned such that the first back 304 abuts the mounting surface 510, the first top 308 is proximate the lip 154, and the first bottom 310 is proximate a top door surface 515 of the doors 144.

Figure 8:
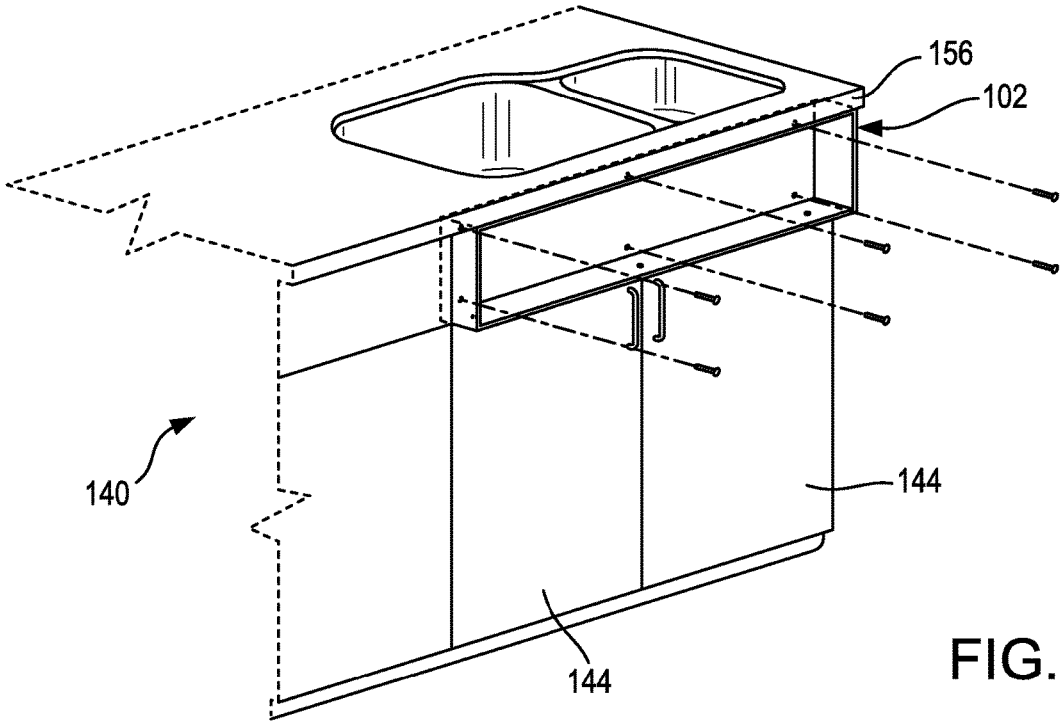

Referring now to FIG. 8, coupling the first mounting body 102 to the cabinet assembly 140 at the location where the panel (e.g., the front cabinet panel 505, the false drawer front, etc.) has been removed is shown. Coupling the first mounting body 102 to the cabinet assembly 140 my include using at least one fastener. In some embodiments, the first mounting body 102 is coupled to the front of the cabinet assembly 140. The first mounting body 102 may be coupled to the cabinet assembly 140 at a location where a false drawer front (e.g., the front cabinet panel 505) has been removed from the cabinet assembly 140. More specifically, the first mounting body 102 may be coupled to the mounting surface 510. The first mounting body 102 may be secured by way of rearward extending fasteners (e.g., screws). For example, the fasteners are configured to extend through the counterbores 320 and into the cabinet assembly 140.

Figure 9:
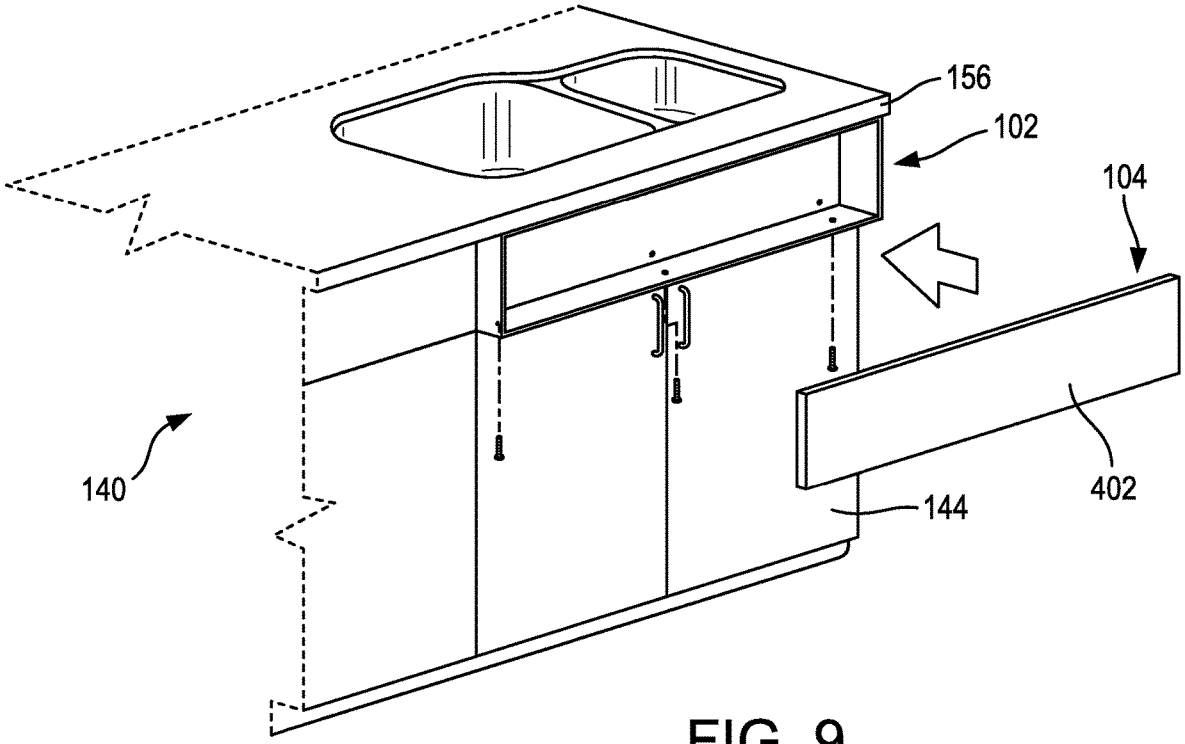

Referring now to FIG. 9, coupling a decorative panel (e.g., the cover panel 104) to the first mounting body 102 is shown. Coupling the decorative panel (e.g., the cover panel 104) to the first mounting body 102 may include inserting at least a portion of the decorative panel (e.g., the cover panel 104) into the first mounting body 102 and inserting a fastener through the first mounting body 102 to engage the cover panel decorative panel and secure the decorative panel in place relative to the first mounting body 102. In some embodiments, the cover panel 104 is coupled to and received entirely within the first opening 306 of the first mounting body 102. In some embodiments, the cover panel 104 is generally planar such that the cover panel front 402 is parallel to the first front 302. The cover panel 104 may be secured to the first mounting body 102 with at least one fastener, the fastener configured to extend through a portion of the first mounting body 102 to engage the cover panel 104 so as to secure the cover panel 104 in place with respect to the first mounting body 102. In some embodiments, vertically extending fasteners may be installed, extending through the bottom apertures 325 in the first bottom 310 and into the cover panel bottom 410 of the cover panel 104 to couple the cover panel 104 to the first mounting body 102. In some embodiments, the cover panel 104 is removably received within the opening 306 of the first mounting body 102 such that the cover panel 104 may be removed and replaced by a different cover panel having a different aesthetic. Of course, other approaches to securing the cover panel 104 to the first mounting body 102 may be used according to other exemplary embodiments (e.g., shims, horizontally-oriented fasteners, adhesives, magnets, etc.).

Figure 10:
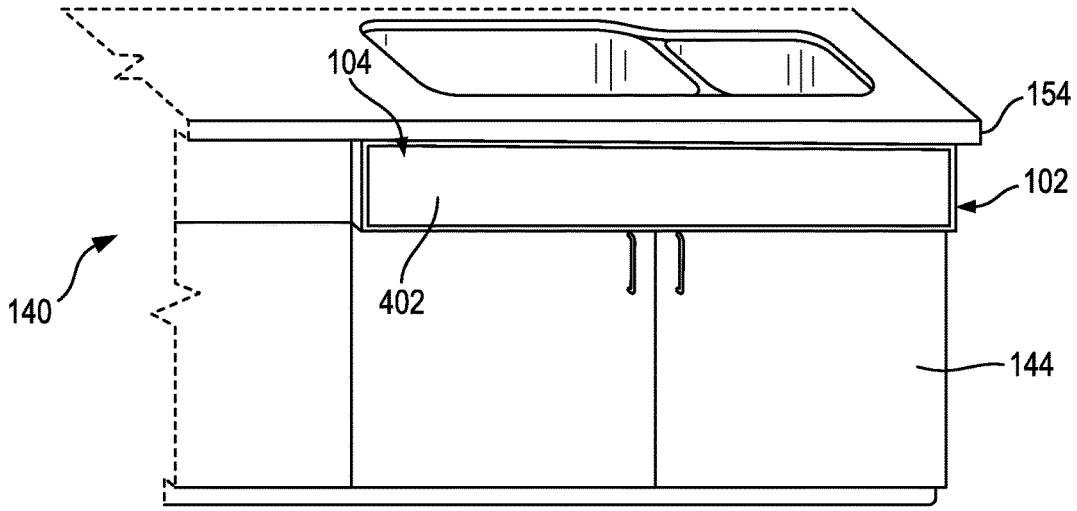

Referring now to FIG. 10, as shown, once installed, the cover panel front 402 is parallel to the front surface 142 of the cabinet assembly 140 and may be visible to a user.

Figure 11:
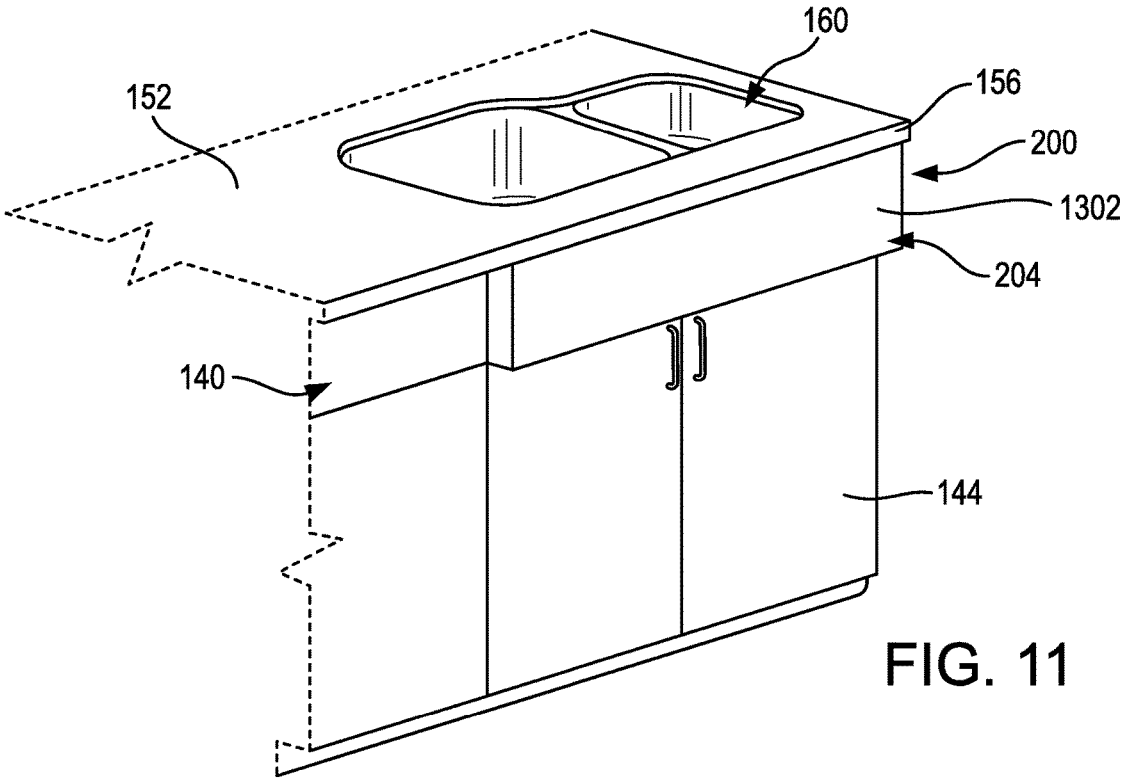
FIG. 11 is the perspective view of the panel assembly of FIG. 2.

Turning now to FIG. 11, the panel assembly 200 is shown. The panel assembly 200 is configured to provide an apron-front aesthetic to the sink installed in the cabinet assembly 140. In some embodiments, the panel assembly 200 is configured to couple to a front portion of the cabinet assembly 140 at a location forward of a sink basin (e.g., the basin of the sink 160) and below the countertop 150 such that at least a portion of the cabinet is between the sink 160 and the panel assembly 200. The panel assembly 200 includes a second mounting body 202 and an end cap 204. The illustrated panel assembly 200 may have a substantially vertical orientation and a substantially rectangular cross section when installed. In some embodiments, the panel assembly 200 has curved sides at an angle relative to the front surface 142. The second mounting body 202 is configured to be a mounting panel, such that the second mounting body 202 is configured to coupling (e.g., is coupled, is directly coupled) to the cabinet assembly 140 for structural support. The end cap 204 is configured to be coupled to the second mounting body 202 to provide an apron-front aesthetic for the sink 160 coupled to the cabinet assembly 140. The end cap 204 is further configured to be a forward facing aesthetic end cap, such that the end cap 204 visible when viewed from the front. The end cap 204 is detachably coupled to the second mounting body 202 such that the aesthetics of the panel assembly 200 can be customized by swapping out the end cap 204 for another end cap with a different aesthetic (e.g., detaching the end cap 204 and attaching a similar end cap). That is, the panel assembly 200 is configured such that the second mounting body 202 can be mounted to the cabinet assembly 140, and a user may selectively change the end cap 204 to provide a different aesthetic look. In this way, the panel assembly 200 provides a customizable and more cost efficient means of obtaining a different aesthetic look around a sink (e.g., the apron of the sink) without actually replacing the entire sink.

Specifically, FIG. 11 illustrates the panel assembly 200 having a first embodiment of the end cap 204, the end cap 204 formed of brushed nickel. The end cap 204 may be manufactured from any variety of metals, such as stainless steel (e.g., 22 gauge 304 stainless steel, etc.), brass, copper, iron, titanium, and similar metals.

Figure 12:
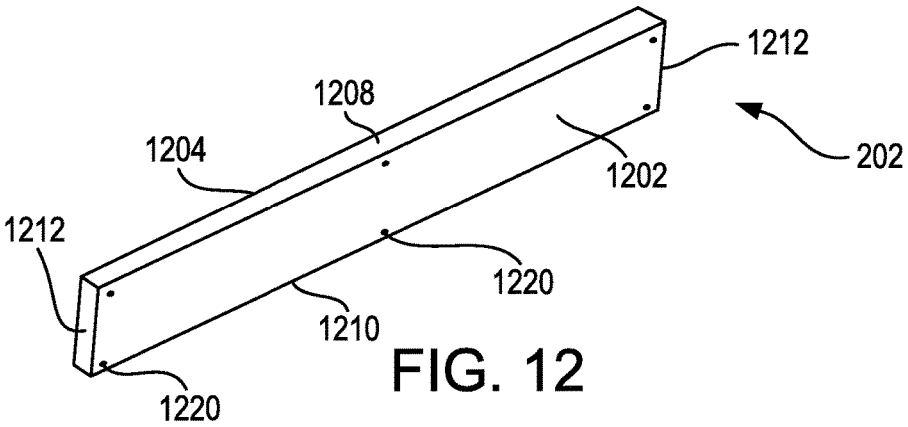
FIG. 12 is a perspective view of a second mounting body for use with the panel assembly shown in FIG. 2.

Referring to FIG. 12, the second mounting body 202 (e.g., mounting panel, mounting plate, fixture panel, fixture, mounting structure, etc.) is shown. The second mounting body 202 is similar to the first mounting body 102. A difference between the two is that the second mounting body 202 is, when the panel assembly 200 is fully assembled, configured to be located within the end cap 204. The second mounting body 202 may include a counterbore 1220 configured to receive a fastener to couple the second mounting body 202 to the front of the cabinet assembly 140. In some embodiments, the second mounting body 202 is coupled at the location where a false drawer would be located. In other embodiments, the second mounting body 202 is located at the location where the panel (e.g., the front cabinet panel 505) was removed. In some embodiments, the second mounting body 202 is configured for coupling to the mounting surface 510. The second mounting body 202 includes a base wall having a second front 1202 and a second back 1204, which are parallel to one another. The second back 1204 is planar and is configured to couple proximate to the front surface 142 of the cabinet assembly 140. The second mounting body 202 further includes a second top 1208, a second bottom 1210, and two second sides 1212. The second top 1208 and the second bottom 1210 may be parallel to one another and perpendicular to each of the two second sides 1212, which are parallel to one another. Thus, the perimeter of the second mounting body 202 may have a substantially rectangular cross section when viewed from the front. In some embodiments, however, the cross-section of the second mounting body 202 may be any one of a variety of regular or irregular polygons, such as a crescent, trapezoid, ellipse, rhombus, and similar shapes. The second front 1202 is shown to include at least one throughgoing counterbore 1220 (e.g., the counterbore 1220 extends from the second front 1202 to the second back 1204). Each counterbore 1220 is configured to receive a rearward extending fastener, which couples the second mounting body 202 to the cabinet assembly 140. That is, when installed, the second back 1204 of the second mounting body 202 will couple to the mounting surface 510. In some embodiments, the second mounting body 202 may include any number of counterbores 1220 that are configured to receive fasteners. Similarly, it should be appreciated that any number or type of fasteners (e.g., bolts, screws, etc.) may be used to couple the second mounting body 202 to the cabinet assembly 140. In addition, in the event that the user instead drills their own holes, it should be appreciated that the second mounting body 202 may not include any counterbores 1220 for receiving fasteners. The second mounting body 202 can be made of, for example, a metal, such as sheet metal or cast.

Figure 13:
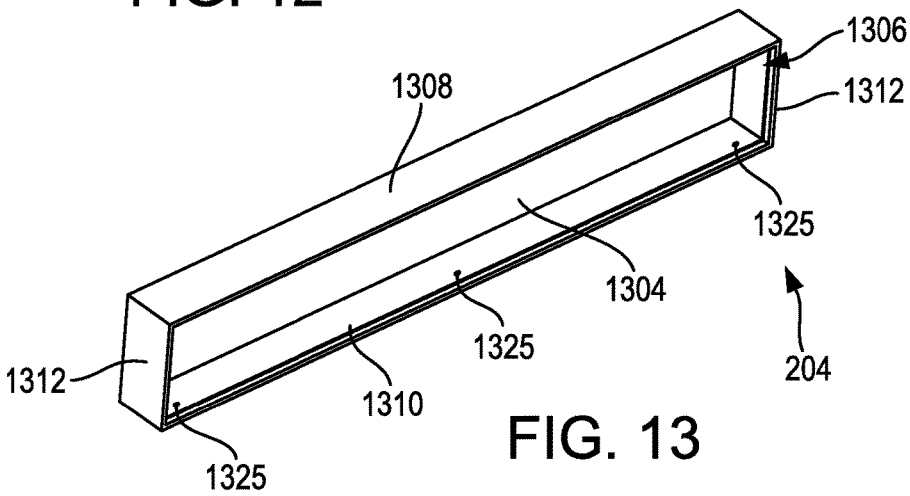
FIG. 13 is a perspective view of the rear of the end cap of FIG. 12.

Referring to FIG. 13, a perspective rear view of the end cap 204 is shown. The end cap 204 includes an end cap front 1302 and an end cap back 1304 substantially parallel to and opposite of the end cap front 1302. The end cap 204 further includes an opening 1306 that is configured to receive the second mounting body 202 therein. Coupling the end cap 204 to the second mounting body 202 may include inserting at least a portion of the second mounting body 202 into the end cap 204 and inserting a fastener through the end cap 204 to engage the second mounting body 202 and secure the end cap 204 in place with respect to the second mounting body 202. The opening 1306 is defined by the end cap back 1304, an end cap top 1308, an end cap bottom 1310, and two end cap sides 1312. The end cap top 1308 and the end cap bottom 1310 of the illustrated end cap 204 may be parallel to one another and perpendicular to each of the two end cap sides 1312, which are parallel to one another. Thus, the perimeter of the opening 1306 may have a substantially rectangular cross section when viewed from the front. In some embodiments, however, the cross-section of the opening 1306 may be any one of a variety of regular or irregular polygons, such as a crescent, trapezoid, ellipse, rhombus, and similar shapes. The end cap bottom 1310 is shown to include at least one bottom aperture 1325 configured to receive a fastener to secure the end cap 204 to the second mounting body 202. For example, the end cap 204 of FIG. 13 is shown to include three bottom apertures 1325, each of which is configured to receive one fastener. Specifically, the end cap 204 is configured to receive at least one fastener extending through the end cap bottom 1310 and interface with second mounting body 202 to couple the end cap 204 to the second mounting body 202. In some embodiments, the end cap 204 may instead be press fit, snapped, latched, slid, nailed, or glued onto the second mounting body 202 such that the bottom apertures 1325 may not be needed. The end cap 204 can be made of, for example, a metal, such as sheet metal or cast (or may be made of other materials according to other exemplary embodiments).

Figure 16:
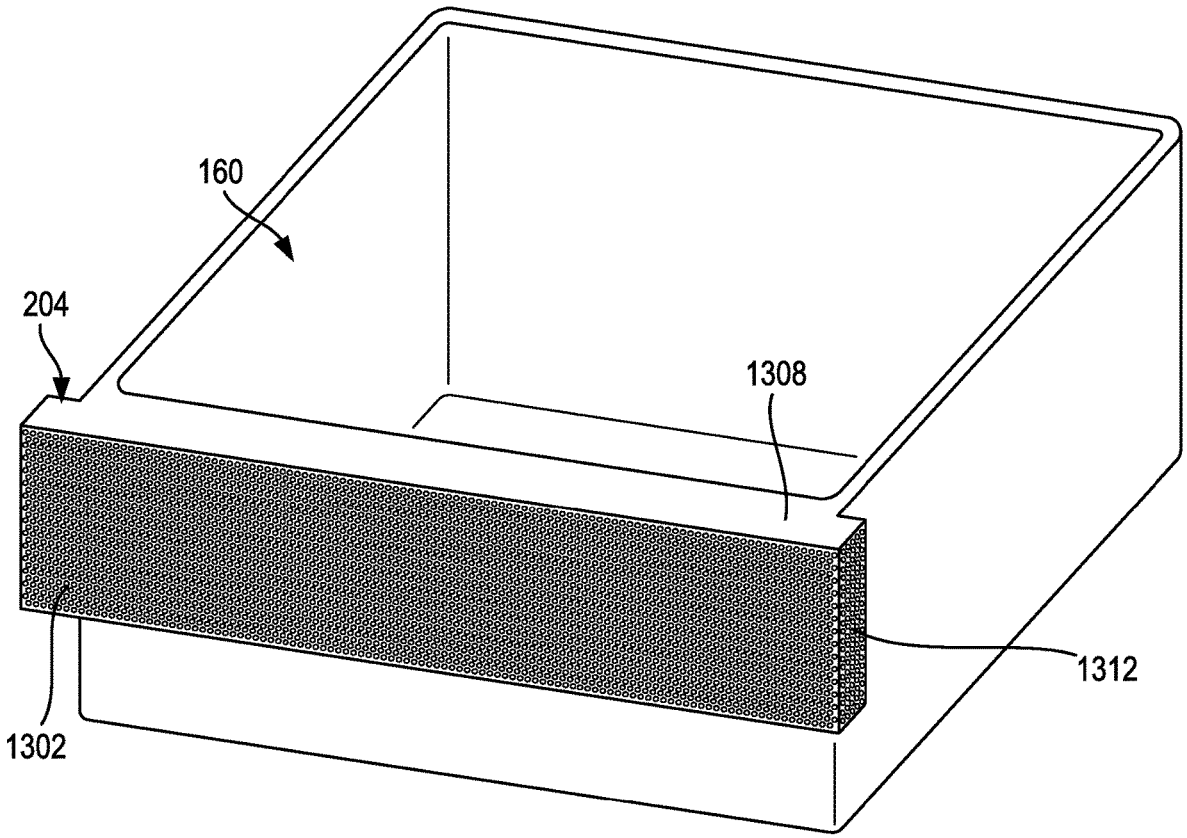
FIG. 16 is a perspective view of the panel assembly shown in FIG. 2 coupled to a sink, according to even yet another embodiment.

The end cap 204 is configured to receive the second mounting body 202 such that the second mounting body 202 is received within the end cap 204. That is, the second mounting body 202 may have a rectangular cross-section that is proportionally slightly smaller than the opening 1306 and matches the cross-section of the end cap 204 such that there are no gaps between the second walls of the second mounting body 202 and the end cap walls of the end cap 204 (e.g., the second top 1208 interfaces with the end cap top 1308 such that there is no space between the second top 1208 and the end cap top 1308, etc.). In some embodiments, the cross-section of the second mounting body 202 is not rectangular, but of another regular or irregular polygon shape. When the panel assembly 200 is installed to the cabinet assembly 140, the end cap front 1302 may be configured to be parallel to the front surface 142. In some embodiments, such as depending on the cabinet and/or sink assembly design, the end cap top 1308 and/or the end cap sides 1312 may also be visible to a user (e.g., when viewed from the top and/or sides) when installed. The end cap top 1308 may have a different aesthetic appeal (e.g., finish, color, etc.) than either the end cap sides 1312 or the end cap front 1302. For example, as seen in FIG. 16, the end cap top 1308 may match a top flange of the sink 160. In some embodiments, the end cap top 1308 may have a first finish, the end cap front 1302 and the end cap sides 1312 may have a second finish different from the first finish, and the top flange of the sink 160 may have a third finish which matches the first finish. In other embodiments, the third finish and the first finish may be different. In some embodiments, the panel assembly 200 is integrally manufactured to the sink The end cap front 1302 may be further configured to be visible to a user when the end cap 204 is installed onto and around the second mounting body 202. The end cap front 1302 may be flush with (e.g., in the same plane as) the front lip surface 156. When installed, the end cap back 1304 of the end cap 204 may face and optionally couple to the second front 1202 of the second mounting body 202. In some embodiments, the second bottom 1210 is configured to interface with an upwardly extending fastener, coupling the end cap 204 to the second mounting body 202 upon installation. In other embodiments, the second mounting body 202 includes latches, pins, adhesive, and/or snaps to help couple the end cap 204 to the second mounting body 202.

The end cap 204 may be made of, for example, a deep-textured stainless steel, so as to beneficially provide a scratch resistant property. However, the end cap 204 may also be made of, for example, aluminum, wood, stone, glass, or ceramic, as well as any combination thereof and/or any other suitable material, which can be replaced or interchanged to tailor the aesthetics of the panel assembly 200. The end cap 204 may be formed of a material different from the second mounting body 202. For example, the second mounting body 202 may be formed of a first material, such as stainless steel, and the end cap 204 may be formed of a second material different from the first material, such as wood. The end cap 204 may further have an aesthetically pleasing finish (e.g., the end cap 204 includes a decorative pattern). In some embodiments, the end cap 204 may have the same finish as the sink 160 such that the end cap 204 and the sink 160 are the same color. In some embodiments, the end cap 204 has a metallic finish. In some embodiments, the end cap 204 has a textured surface finish. As will be appreciated by those of ordinary skill, the end cap 204 may be formed of plastic, but may be given a metallic or reflective finish through plastic chrome plating, vacuum metalizing, or chrome spray paint.

Figure 14:
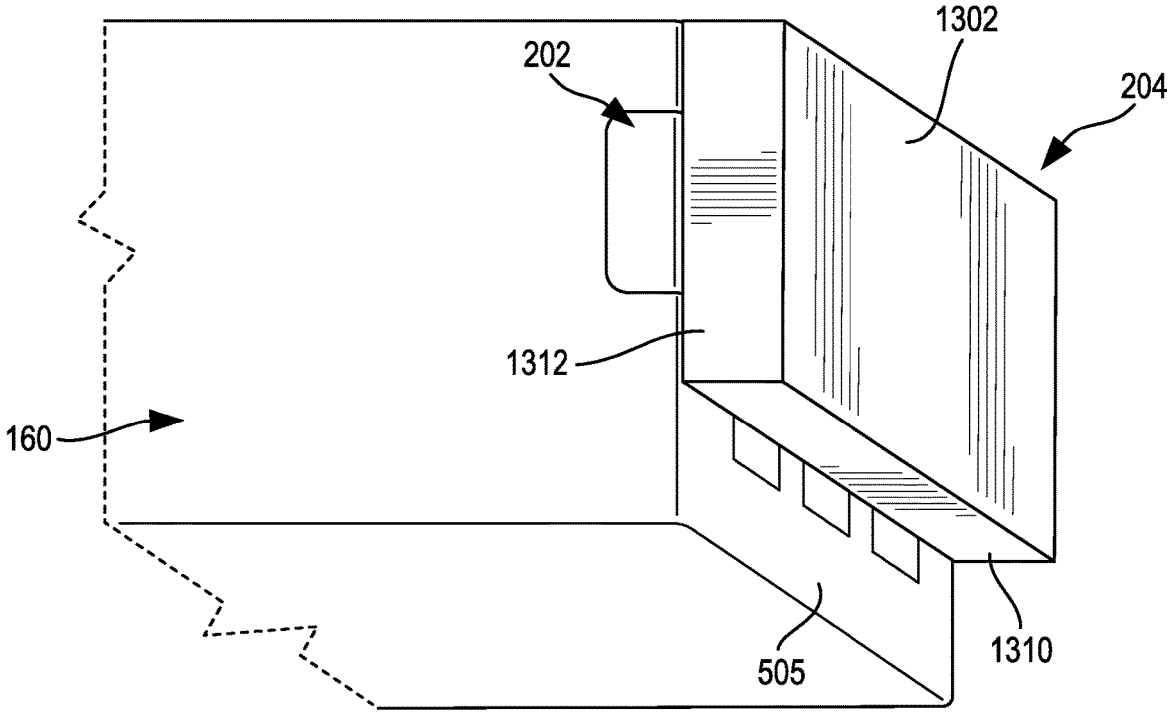
FIG. 14 is a perspective view of the panel assembly shown in FIG. 2 coupled to a sink, according to another embodiment.

Turning to FIG. 14, another embodiment of the panel assembly 200 is shown according to an exemplary embodiment. The panel assembly 200 of FIG. 14 is coupled to the front of a non-front-apron front sink, such as the sink 160, to provide an apron-front sink aesthetic. The panel assembly 200 in FIG. 14 is similar to the panel assembly 200 in FIG. 11. A difference between the two is that the sink 160 includes the mounting surface 510 (as opposed to the cabinet assembly 140 having the mounting surface 510). The second mounting body 202 is coupled to the mounting surface 510 of the sink 160. The end cap 204 is then coupled to the second mounting body 202, completely enclosing the second mounting body 202 and hiding the second mounting body 202 from view when the panel assembly 200 is viewed from the front. The end cap 204 and the mounting surface 510 may have the same width (e.g., a distance between the two end cap sides 1312). As shown in FIG. 14, the end cap 204 is formed of a hammered steel. However, the end cap 204 may alternatively be made of, for example, aluminum, wood, stone, glass, or ceramic, as well as any combination thereof and/or any other suitable material, which can be replaced or interchanged to tailor the aesthetics of the panel assembly 200. In some embodiments, the end cap 204 and the sink 160 have the same finish and/or the same color.

Figure 15:
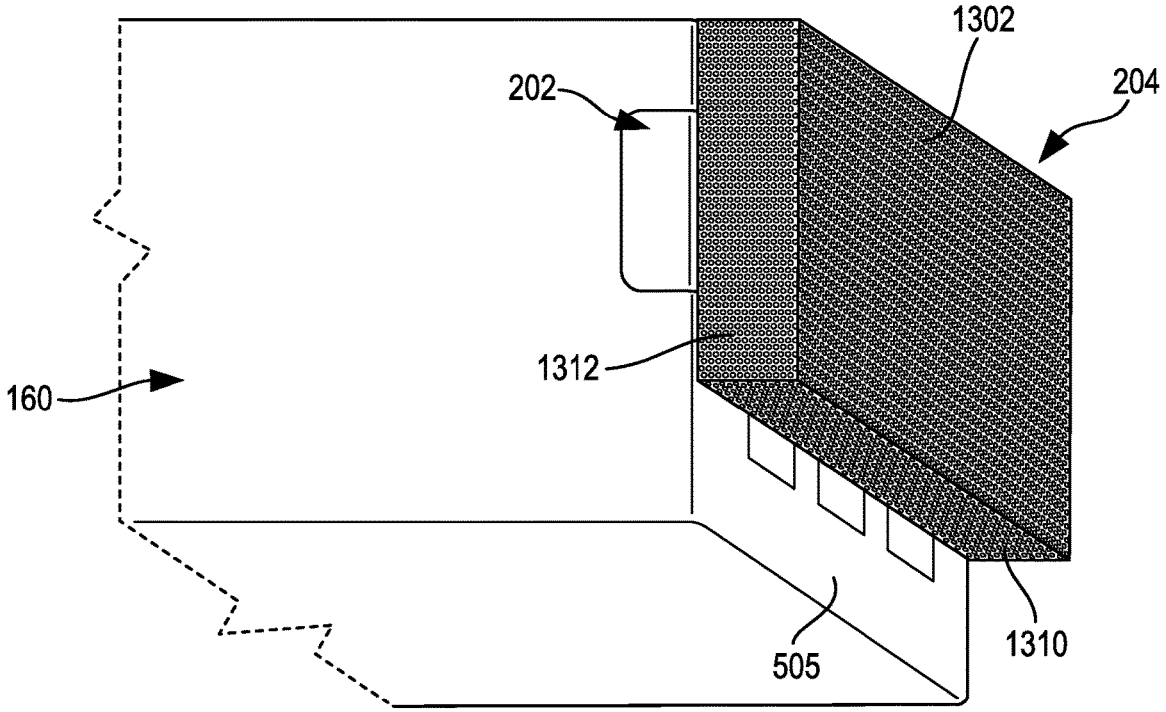
FIG. 15 is a perspective view of the panel assembly shown in FIG. 2 coupled to a sink, according to yet another embodiment.

Turning to FIG. 15, yet another embodiment of the panel assembly 200 is shown according to an exemplary embodiment. The panel assembly 200 of FIG. 15 is similar to the panel assembly 200 of FIG. 14. A difference between the two is that the end cap front 1302 of the end cap 204 of FIG. 15 is formed of a scratch resistant, deep-textured stainless steel. FIG. 15 illustrates a dimpled texture, which is aesthetically appealing. In addition, the dimpled texture also diffuses light (i.e., reduces light reflection), which may reduce the visibility of blemishes on the end cap front 1302 that may have otherwise been easily apparent.

Turning to FIG. 16, even yet another embodiment of the panel assembly 200 according to an exemplary embodiment. The panel assembly 200 of FIG. 16 is similar to the panel assembly 200 of FIG. 14. A difference between the two is that the end cap 204 of FIG. 16 is taller than the end cap 204 of FIG. 14 (e.g., a distance between the end cap top 1308 and the end cap bottom 1310 is greater in FIG. 16 than in FIG. 14). The height of the panel assembly 200 may be adjusted to accommodate different sized sinks (e.g., the sink 160) and different sized mounting surfaces (e.g., the mounting surface 510, the surface defined by the lip 154 and the doors 144, a desired surface to be covered, etc.). Another difference between the panel assembly 200 of FIG. 14 and the panel assembly 200 of FIG. 16 is that the end cap top 1308 is contiguous with the top flange of the sink 160. The end cap 204 may be manufactured to be structurally integral with the sink 160. An advantage of this integration is that the second mounting body 202 is not required to mount the end cap 204 to the sink 160. In some embodiments, the countertop 150 is not disposed above the end cap top 1308 such that the end cap top 1308 is visible to a user from the front of the cabinet assembly 140. In some embodiments, the countertop 150 is only disposed above a portion of the end cap top 1308 (e.g., an overhang of the end cap 204 proximate the end cap sides 1312 and extending laterally away from and beyond the sink 160). The integration of the end cap 204 with the sink 160 may help a user clean the end cap top 1308 as there is no discontinuity between the end cap top 1308 and the top flange of the sink 160 for dirt or debris to gather. In some embodiments, the end cap bottom 1310 interfaces with the cabinet assembly 140, the cabinet assembly 140 hiding a bottom portion of the basin of the sink 160 from view, the bottom portion of the sink 160 extending below the end cap bottom 1310. The end cap 204 and the sink 160 may be integrally manufactured such that the end cap 204 and the sink 160 are a single piece (e.g., the end cap 204 and the sink 160 are of a one-piece configuration, the end cap 204 and the sink 160 are cast together, the end cap 204 and the sink 160 are integrally structured together, etc.). The end cap 204 may have a finish similar to the finish of the end cap 204 of FIG. 14 or the end cap 204 of FIG. 15.

Figure 17A:
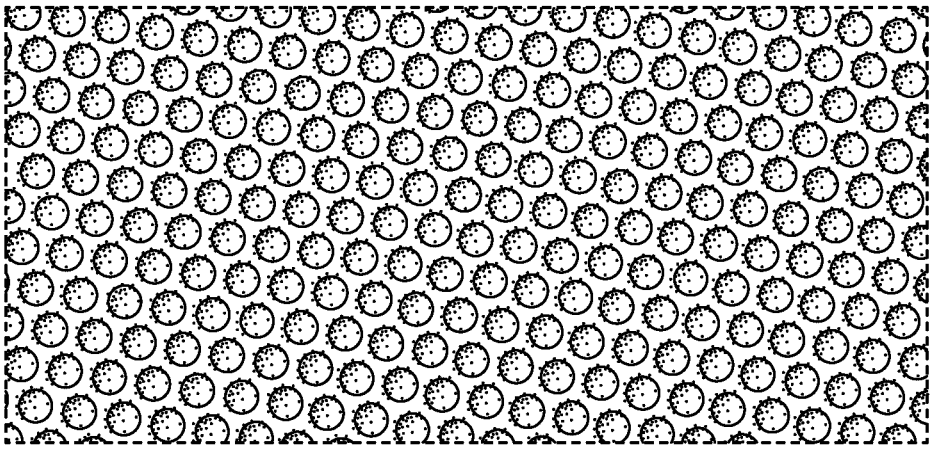
FIG. 17A illustrates an enlarged schematic of deep-textured stainless steel.
Figure 17B:
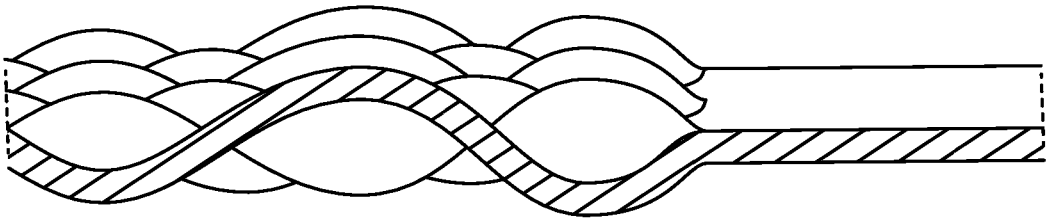
FIG. 17B illustrates an enlarged cross-sectional view of the deep-textured stainless steel of FIG. 17A.
Figure 17C:
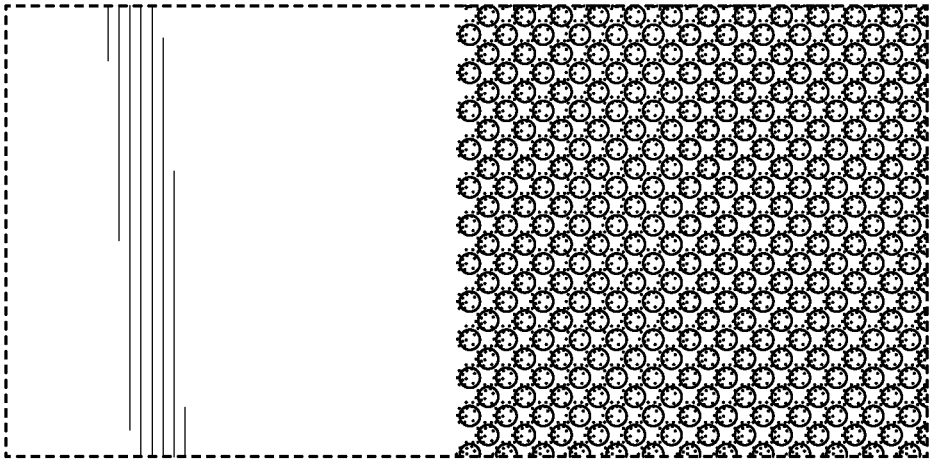
FIG. 17C illustrates a comparison of the scratch resistance of a non-textured stainless steel surface compared to a deep-textured stainless steel surface.

The end cap 204 is shown to have a variety of possible textured appearances (i.e., rippled, dimpled, woven, peened, etc.). However, it should be appreciated that the end cap 204 is not limited to only the textures shown. FIGS. 17A-17C illustrate three enlarged views of the stainless steel finish used for the end cap 204. Specifically, FIGS. 17A-17C illustrate various views of 22 gauge 304 stainless steel when it is plastically deformed such that the material has been stretched to form convex and concave surfaces. Turning to FIG. 17A, a zoomed-in view of the end cap 204 shown in FIGS. 15 and 16. The end cap 204 includes deep-texturing, creating a dimpled appearance.

FIG. 17B is an enlarged, cross-sectional view of the sheet of stainless steel. The process of deep-texturing a sheet of stainless steel metal effectively includes the metal being stretched to exceed the yield point of the metal, causing it to plastically deform (i.e., strain hardening). However, once the yield point of the material is reached, higher levels of stress are required to continue the deformation of the material. In other words, after being plastically deformed, the material increasingly gets stronger until reaching a maximum yield point. Depending on the process and tooling used, deep-textured metal can be deformed to create various patterns and shapes having convex and concave portions. Thus, the deep-textured (i.e., non-flat) portion of the stainless steel sheet may exhibit improved strength properties compared to a flat sheet of steel, because the deep-textured portion has been strain hardened. Further, by providing a deep-textured surface, a part can be made stronger without requiring additional or a denser material, thus remaining weight-efficient.

Lastly, FIG. 17C demonstrates a side-by-side comparison of a flat sheet of stainless steel (e.g., the end cap 204 having a smooth finish) on the left, and a textured sheet of stainless steel (e.g., the end cap 204, similar to as shown in FIGS. 14-16) on the right. As can be seen, the textured stainless steel surface exhibits much higher scratch resistance and conceals blemishes or imperfections better than the flat surface. This is so partially due to the improved strength of utilizing a deep-textured finish, since the surface is stronger and more durable, thus allowing fewer scratches to penetrate the surface. In addition, the deep-textured finish on the right diffuses the light reflection, thus making any scratches or blemishes less apparent. It should be appreciated that applying the deep-textured finish to the cover panel 104 or the end cap 204 would beneficially provide an improved scratch resistance, and thus aid in the appearance and durability of the panel assembly 100 or the panel assembly 200, respectively.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A panel assembly for providing an apron-front aesthetic for a sink installed in a cabinet, the panel assembly comprising:

a mounting body separate from a sink and configured for coupling to a cabinet in which the sink is installed; and a cover panel coupled to the mounting body and separated from the cabinet by the mounting body and configured to provide an apron-front aesthetic for the sink when the sink is installed in the cabinet.

2. The panel assembly of claim 1, wherein the mounting body includes an opening and the cover panel is located within the opening.

3. The panel assembly of claim 2, wherein a cover panel back faces a front of the mounting body when the cover panel is coupled to the mounting body.

4. The panel assembly of claim 1, wherein the mounting body is configured for coupling to a portion of the cabinet in front of the sink.

5. The panel assembly of claim 1, further comprising a fastener configured to extend through a portion of the mounting body to engage the cover panel so as to secure the cover panel in place with respect to the mounting body.

6. The panel assembly of claim 1, wherein the cover panel is generally planar.

7. The panel assembly of claim 1, wherein the cover panel has a metallic finish.

8. The panel assembly of claim 1, wherein the cover panel has a textured surface finish.

9. The panel assembly of claim 1, wherein the mounting body is formed of a first material and the cover panel is formed of a second material that is different from the first material.

10. The panel assembly of claim 1, wherein:

the mounting body comprises a base wall comprising:

a back, a front opposite the back, a top contiguous with the back and the front, a first side contiguous with the top, the front, and the back, a second side contiguous with the top, the front, and the back, and a bottom contiguous with the back, the front, the first side, and the second side;

the top, the first side, the second side, and the bottom cooperate to define an opening; and at least a portion of the cover panel is received within the opening.

11. The panel assembly of claim 10, wherein:

the top is planar;

the bottom is planar and parallel to the top;

the first side is planar; and the second side is planar and parallel to the first side.

12. The panel assembly of claim 11, wherein:

the front is planar; and the back is planar and parallel to the front.

13. The panel assembly of claim 11, wherein the front is planar and orthogonal to the first side, the second side, the top, and the bottom.

14. The panel assembly of claim 11, wherein the back is planar and orthogonal to the first side, the second side, the top, and the bottom.

15. The panel assembly of claim 11, wherein:

the cover panel comprises:

a cover panel back, a cover panel front opposite the cover panel back, a cover panel top contiguous with the cover panel back and the cover panel front, a first cover panel side contiguous with the cover panel top, the cover panel front, and the cover panel back, a second cover panel side contiguous with the cover panel top, the cover panel front, and the cover panel back, and a cover panel bottom contiguous with the cover panel back, the cover panel front, the first cover panel side, and the second cover panel side;

a portion of the cover panel top is received within the opening and in confronting relation with the top;

a portion of the cover panel bottom is received within the opening and in confronting relation with the bottom;

a portion of the first cover panel side is received within the opening and in confronting relation with the first side; and a portion of the second cover panel side is received within the opening and in confronting relation with the second side.

16. The panel assembly of claim 15, wherein:

the cover panel top is planar;

the cover panel bottom is planar and parallel to the cover panel top;

the first cover panel side is planar; and the second cover panel side is planar and parallel to the first cover panel side.

17. The panel assembly of claim 16, wherein:

the cover panel front is planar; and the cover panel back is planar and parallel to the cover panel front.

18. The panel assembly of claim 15, wherein the cover panel front is planar and orthogonal to the first cover panel side, the second cover panel side, the cover panel top, and the cover panel bottom.

19. The panel assembly of claim 15, wherein:

the cover panel top is planar;

the top is planar and parallel to the cover panel top;

the cover panel bottom is planar and parallel to the cover panel top;

the bottom is planar and parallel to the cover panel bottom;

the first cover panel side is planar;

the first side is planar is parallel to the first cover panel side;

the second cover panel side is planar and parallel to the first cover panel side; and the second side is planar is parallel to the second cover panel side.

20. The panel assembly of claim 1, wherein a back of the cover panel faces a front of the mounting body when the cover panel is coupled to the mounting body.

21. A panel assembly for providing an apron-front aesthetic for a sink installed in a cabinet, the panel assembly comprising:

a mounting body separate from a sink and configured for coupling to a cabinet in which the sink is installed; and a cover panel coupled to the mounting body to provide an apron-front aesthetic for the sink when the sink is installed in the cabinet;

wherein the mounting body includes an opening and the cover panel is located within the opening.

22. A panel assembly for providing an apron-front aesthetic for a sink installed in a cabinet, the panel assembly comprising:

a mounting body separate from a sink and configured for coupling to a cabinet in which the sink is installed;

a cover panel coupled to the mounting body to provide an apron-front aesthetic for the sink when the sink is installed in the cabinet; and a fastener configured to extend through a portion of the mounting body to engage the cover panel so as to secure the cover panel in place with respect to the mounting body.

* * * * *